US007301092B1

(12) United States Patent
McNally et al.

(10) Patent No.: US 7,301,092 B1
(45) Date of Patent: Nov. 27, 2007

(54) METHOD AND APPARATUS FOR SYNCHRONIZING AUDIO AND VIDEO COMPONENTS OF MULTIMEDIA PRESENTATIONS BY IDENTIFYING BEATS IN A MUSIC SIGNAL

(75) Inventors: Guy W. W. McNally, Los Altos, CA (US); Christopher J. Zamara, Gilroy, CA (US); Charmine S. Tung, Sunnyvale, CA (US)

(73) Assignee: Pinnacle Systems, Inc., Mountian View, CA (US)

( * ) Notice: Subject to any disclaimer, the term of this patent is extended or adjusted under 35 U.S.C. 154(b) by 359 days.

(21) Appl. No.: 10/816,737

(22) Filed: Apr. 1, 2004

(51) Int. Cl.
*G10H 7/00* (2006.01)

(52) U.S. Cl. ..... 84/612; 84/636

(58) Field of Classification Search ..... 84/612, 84/636

See application file for complete search history.

(56) References Cited

U.S. PATENT DOCUMENTS 7,026,536 B2 * 4/2006 Lu et al. ..... 84/612
2002/0148347 A1 * 10/2002 Herberger et al. ..... 84/636

OTHER PUBLICATIONS

Hone et al., "Making Movies With Your PC," 458 pages, Stefan Grünwedel (editor), Prima Publishing, 1994.
Ozer, Jan, "Visual Quickstart Guide, Pinnacle Studio 9 for Windows," 468 pages, Jill Marts Lodwig (editor), Peachpit Press, 2004.
Tzanetakis, George, et al., "Audio Analysis using the Discrete Wavelet Transform," In Proceedings WSES Int. Conf. Acoustics and Music: Theory and Applications (AMTA 2001) Skiathos, Greece, 2001, 6 pages [unnumbered].
muvee Technologies, News Release, "muvee autoProducer DVD Edition Awarded 4 Stars by PC Magazine," 2 pages, Apr. 30, 2003.
muvee Technologies, News Release, "muvee Technologies launches muvee autoProducer—the worlds's only smart automatic video editing software," 2 pages, issued Oct. 29, 2001.
Alghoniemy, Masoud, et al., "Rhythm and Periodicity Detection in Polyphonic Music," Proc. IEEE Third Workshop on Multimedia Signal Processing, pp. 185-190, Denmark, Sep. 1999.
Allen, Paul E., et al., "Tracking Musical Beats in Real Time," in *1990 International Computer Music Conference*, International Computer Music Association (Sep. 1990), pp. 140-143.
Blackburn, Steven G., "Search by Humming," *Faculty of Engineering, University of Southampton, U.K.* (B.Sc. in Computer Science Project Report), 69 pages (incl. title page & pp. 1-68), May 8, 1997.

(Continued)

*Primary Examiner*—Jeffrey Donels
(74) *Attorney, Agent, or Firm*—Peter J. Gordon; John A. Hamilton

(57) ABSTRACT

Methods and systems for detecting a fundamental beat frequency in a predetermined time interval of a music signal are disclosed. The frequency may be detected by processing a music signal with the discrete wavelet transform to obtain a set of coefficients. A subset of the coefficients may be processed to obtain a plurality of candidate beat frequencies contained in the corresponding portion of the music signal. Harmonic relationships between the candidate beat frequencies may be determined, and the fundamental beat frequency may then be determined based upon the determined harmonic relationships.

17 Claims, 13 Drawing Sheets

OTHER PUBLICATIONS

Cheng, Kileen, et al., "Beat This: A Beat Synchronization Project: Home," Rice University, Houston, TX, available at http://www.owlnet.rice.edu/~elec301/Projects01/beat_sync/index.html, 2 pages, © 2001.
Cheng, Kileen, et al., "Beat This: A Beat Synchronization Project: Background," Rice University, Houston, TX, available at http://www.owlnet.rice.edu/~elec301/Projects01/beat_sync/background.html, 2 pages, © 2001.
Cheng, Kileen, et al., "Beat This: A Beat Synchronization Project: Beat Detection Algorithm," Rice University, Houston, TX, available at http://www.owlnet.rice.edc/~elec301/Projects01/beat_sync/beatalgo.html, 6 pages, © 2001.
Cheng, Kileen, et al., "Beat This: A Beat Synchronization Project: Time Scaling Algorithm," Rice University, Houston, TX, available at http://www.owlnet.rice.edu/~elec301/Projects01/beat_sync/timescale.html, 2 pages, © 2001.
Cheng, Kileen, et al., "Beat This: A Beat Synchronization Project: Phase Alignment Algorithm," Rice University, Houston, TX, available at http://www.owlnet.rice.edu/~elec301/Projects01/beat_sync/phasealign.html, 3 pages, © 2001.
Cheng, Kileen, et al., "Beat This: A Beat Synchronization Project: Results," Rice University, Houston, TX, available at http://www.owlnet.rice.edu/~elec301/Projects01/beat_sync/results.html, 2 pages, © 2001.
Cheng, Kileen, et al., "Beat This: A Beat Synchronization Project: Conclusions," Rice University, Houston, TX, available at http://www.owlnet.rice.edu/~elec301/Projects01/beat_sync/conclusions.html, 2 pages, © 2001.
Cheng, Kileen, et al., "Beat This: A Beat Synchronization Project: References, " Rice University, Houston, TX, available at http://www.owlnet.rice.edu/~elec301/Projects01/beat_sync/references.html, 2 pages, © 2001.
Cheng, Kileen, et al., "Beat This: A Beat Synchronization Project: Matlab Code: Filterbank," Rice University, Houston, TX, available at http://www.owlnet.rice.edu/~elec301/Projects01/beat_sync/code/filterbank.m, 1 page, © 2001.
Cheng, Kileen, et al., "Beat This: A Beat Synchronization Project: Matlab Code: Hwindow," Rice University, Houston, TX, available at http://www.owlnett.rice.edu/~elec301/Projects01/beat_sync/code/hwindow.m, 2 pages, © 2001.
Cheng, Kileen, et al., "Beat This: A Beat Synchronization Project: Matlab Code: Differentiation," Rice University, Houston, TX, available at http://www.owlnet.rice.edu/~elec301/Projects01/beat_sync/code/diffrect.m, 1 page, © 2001.
Cheng, Kileen, et al., "Beat This: A Beat Synchronization Project: Matlab Code: Timecomb," Rice University, Houston, TX, available at http://www.owlnet.rice.edu/~elec301/Projects01/beat_sync/code/timecomb.m, 2 pages, © 2001.
Cheng, Kileen, et al., "Beat This: A Beat Synchronization Project: Matlab Code: Control," Rice University, Houston, TX, available at http://www.owlnet.rice.edu/~elec301/Projects01/beat_sync/control.m, 3 pages, © 2001.
Cheng, Kileen, et al., "Beat This: A Beat Synchronization Project: Signal Image," Rice University, Houston, TX, available at http://www.owlnet.rice.edu/~elec301/Projects01/beat_sync/images/plot1.gif, 1 page, © 2001.
Cheng, Kileen, et al., "Beat This: A Beat Synchronization Project: Hanning Window Images," Rice University, Houston, TX, available at http://www.owlnet.rice.edu/~elec301/Projects01/beat_sync/images/plot2.gif, 1 page, © 2001.
Cheng, Kileen, et al., "Beat This: A Beat Synchronization Project: Differentiated Images," Rice University, Houston, TX, available at http://www.owlnet.rice.edu/~elec301/Projects01/beat_sync/images/plot3.gif, 1 pages, © 2001.
Cheng, Kileen, et al., "Beat This: A Beat Synchronization Project: Comb Filterbank Images," Rice University, Houston, TX, available at http://www.owlnet.rice.edu/~elec301/Projects01/beat_sync/plot4.gif, 1 page, © 2001.
Cheng, Kileen, et al., "Beat This: A Beat Synchronization Project: Matlab Code: Timescale," Rice University, Houston, TX, available at http://www.owlnet.rice.edu/~elec301/Projects01/beat_sync/code/timescale.m, 1 page, © 2001.
Cheng, Kileen, et al., "Beat This: A Beat Synchronization Project: Matlab Code: Phase Align," Rice University, Houston, TX, available at http://www.owlnet.rice.edu/~elec301/Projects01/beat_sync/phasealign.m, 2 pages, © 2001.
Cheng, Kileen, et al., "Beat This: A Beat Synchronization Project: First Beat Images," Rice University, Houston, TX, available at http://www.owlnet.rice.edu/~elec301/Projects01/beat_sync/images/plot5.gif, 1 page, © 2001.
Cheng, Kileen, et al., "Beat This: A Beat Synchronization Project: Phase Alignment Images," Rice University, Houston, TX, available at http://www.owlnet.rice.edu/~elec301/Projects01/beat_sync/images/plot6.gif, 1 page, © 2001.
Dixon, Simon, "An Interactive Beat Tracking and Visualisation System," in Proceedings of the International Computer Music Conference (ICMC 2001), La Habana, Cuba, 4 pages [unnumbered].
Escobar, Margarita, "Beat Detection in Music Using Average Mutual Information," (graduate thesis) Engineer Technology, University of Miami Music, pp. 3-90, 2001, available at http://www.music.miami.edu/programs/Mue/mue2003/research/graduate.htm, last accessed Jul. 21, 2004.
Forrest, James, "Tuning and Timbre Applet," available at http://eceserv0.ece.wisc.edu/~sethares/forrestjava/tuningandtimbre.html, 2 pages, last accessed on Jun. 12, 2002.
Fowlkes, Charless, et al., "Audio Morphing and Tempo Detection Using Fourier Analysis (CS20c Project Final Report)," available at http://www.cs.caltech.edu/~fowlkes/writeup, pp. 1-9, May 25, 2005.
Goto, Masataka, "An Audio-based Real-time Beat Tracking System for Music With or Without Drum-sounds," *Journal of New Music Research*, vol. 30, No. 2, pp. 159-171 (2001).
Goto, Masataka, et al., "A Beat Tracking System for Acoustic Signals of Music," Association of Computing Machinery, in Proceedings of the Second ACM International Conference on Multimedia, pp. 365-372, 1994, ISBN 0-89791-686-7.
Hone et al., "Making Movies With Your PC," 458 pages, Stefan Grünwedel (editor), Prima Publishing, 1994.
Scheirer, Eric D., "Music-Listening System" (Ph.D. Thesis), School of Architecture and Planning, Massachusetts Institute of Technology, MA, pp. 1-248, Jun. 2000.
Scheirer, Eric D., "Tempo and beat analysis of acoustic musical signals," *J. Acoust. Soc. Am. 103*(*1*), pp. 588-601, Jan. 1998.
Searle, Brian C., "[Example Code: Matlab/FFT and AR]," available at http://www.dartmouth.edu/~searleb/matlab/sleep.html, as of Apr. 23, 2002, 1 page.
Searle, Brian C., "[Example Code: Matlab]," available at http://www.dartmouth.edu/~searleb/matlab/sleep/menu.html, as of Apr. 23, 2002, 2 pages.
Searle, Brian C., "[Example Code: Matlab/sleepplot]," available at http://www.dartmouth.edu/~searleb/matlab/sleep/sleepplot.html, as of Apr. 23, 2002, 4 pages.
Searle, Brian C., "[Example Code: Matlab/sleepedit]," available at http://www.dartmouth.edu/~searleb/matlab/sleep/sleepedit.html, as of Apr. 23, 2002, 1 page.
Searle, Brian C., "[Example Code: Matlab/sleepduelpick]," available at http://www.dartmouth.edu/~searleb/matlab/sleep/sleepduelpick.html, as of Apr. 23, 2002, 1 page.
Searle, Brian C., "[Example Code: Matlab/sleepduel]," available at http://www.dartmouth.edu/~searleb/matlab/sleep/sleepduel.html, as of Apr. 23, 2002, 2 pages.
Searle, Brian C., "[Example Code: Matlab/sleepdelete]," available at http://www.dartmouth.edu/~searleb/matlab/sleep/sleepdelete.html, as of Apr. 23, 2002, 1 page.
Searle, Brian C., "[Example Code: Matlab/sleep analyze]," available at http://www.dartmouth.edu/~searleb/matlab/sleep/sleepanalyze.html, as of Apr. 23, 2002, 2 pages.
Searle, Brian C., "[Example Code: Matlab/sleep add]," available at http://www.dartmouth.edu/~searleb/matlab/sleep/sleepadd.html, as of Apr. 23, 2002, 2 pages.

Searle, Brian C., "[Example Code: Matlab/etedit]," available at http://www.dartmouth.edu/~searleb/matlab/sleep/etedit.html, as of Apr. 23, 2002, 1 page.
Searle, Brian C., "[Example Code: Matlab/fmdir]," available at http://www.dartmouth.edu/~searleb/matlab/sleep/fmdir.html, as of Apr. 23, 2002, 1 page.
Searle, Brian C., "[Example Code: Matlab/sleep menu]," available at http://www.dartmouth.edu/~searleb/matlab/sleep/sleep.jpg, as of Apr. 23, 2002, 1 page.
Searle, Brian C., "[Example Code: Matlab/sleep peak picker]," available at http://www.dartmouth.edu/~searleb/matlab/sleep/sleep-peakpicker.jpg, as of Apr. 23, 2002, 1 page.
Searle, Brian C., "[Example Code: Matlab/sleep autoregressive]," available at http://www.dartmouth.edu/~searleb/matlab/sleeps/sleepanalyze.jpg, as of Apr. 23, 2002, 1 page.
Searle, Brian C., "[Example Code: Matlab/sleep autogressive, duel]," available at http://www.dartmouth.edu/~searleb/matlab/sleep/sleepduel.jpg, as of Apr. 23, 2002, 1 page.
Seppänen, Jarno, "Computational Models of Musical Meter Recognition" (M.Sc. Thesis), *Department of Information Technology, Tampere University of Technology*, Finland, 80 pages (incl. title page, pp. ii-vii & pp. 1-72), Nov. 1, 2001.
Sethares, William A., "Acoustical Signal Processing," available at http://eceserv0.ece.wisc.edu/~sethares/percept.html, 2 pages, 1999.
Sethares, William A., "Adaptive Tunings for Musical Scales," available at http://eceserv0.ece.wisc.edu/~sethares/papers/adaptun.html, 1 page, 1999.
Sethares, William A., "Consonance Based Spectral Mappings," available at http://eceserv0.ece.wisc.edu/~sethares/papers/specmap.html, 1 page, 1999.
Sethares, William A., "Local Consonance and the Relationship Between Timbre and Scale," http://eceserv0.ece.wisc.edu/~sethares/papers/consance.html, 2 pages, 1999.
Sethares, William A., "Relating Tuning and Timbre," available at http://eceserv0.ece.wisc.edu/~sethares/consemi.html, 24 pages, 1999.
Sethares, William A., "Selected Publications," available at http://eceserv0.ece.wisc.edu/~sethares/pubs.html, 10 pages, 1999.
Sethares, William A., "Some Useful Computer Programs," available at http://eceserv0.ece.wisc.edu/~sethares/comprog.html, 3 pages, 1999.
Sethares, William A., "Tuning Timbre Spectrum Scale Table of Contents," available at http://eceserv0.ece.wisc.edu/~sethares/contents.html, as of Jun. 12, 2002.
Sethares, William A. et al., "Periodicity Transforms," available at http://eceserv0.ece.wisc.edu/~sethares/periodic.html, 2 pages, 1999.
Toews, Dan et al., "Design Specifications for the Pace Maker Beat Recognition System," Simon Frasier University School of Engineering Science, *Simplesmart Inc*., 29 pages (incl. title page, abstract page, & pp. 1-27), Oct. 15, 2001, available at http://www.ensc.sfu.ca/users/whitmore/public-html/courses/305/2001/sstdesi.pdf.
Tzanetakis, George, "Tutorial on Music Information Retrieval for Audio Signals," distributed at International Symposium on Music Information Retrieval, 2002, 2 pages [unnumbered].
Tzanetakis, George, et al., "Human Perception and Computer Extraction of Musical Beat Strength," *Proc. of the 5th Int. Conference on Digital Audio Effects*, (*DAFX-02*), Hamburg, Germany, pp. 1-5, Sep. 26-28, 2002.
Uhle, Christian, et al., "Estimation of Tempo, Micro Time and Time Signature from Percussive Music," *Proc. of the 6th Int. Conference on Digital Audio Effects* (*DAFX-03*) London, UK, pp. 1-6, Sep. 8-11, 2003.
Wang, Ye, et al., "A Compressed Domain Beat Detector using MP3 Audio Bitstreams," Association for Computing Machinery, in Proceedings of the Ninth ACM International Conference on Multimedia, pp. 194-202, Ottawa, Canada, 2001, also available at http://www.acum.org/sigs/sigmm/mm2001/ep/wang.

* cited by examiner

| Bin # | Frequency | Bin value |
|---|---|---|
| | F1 | RA1 |
| | F2 | RA2 |
| | F3 | RA3 |
| | F4 | RA4 |
| | F5 | RA5 |
| | F6 | RA6 |

Harmonicity Matrix

| | | | | | |
|---|---|---|---|---|---|
| **F1/F1** | **F1/F2** | **F1/F3** | **F1/F4** | **F1/F5** | **F1/F6** |
| F2/F1 | **F2/F2** | **F2/F3** | **F2/F4** | **F2/F5** | **F2/F6** |
| F3/F1 | F3/F2 | **F3/F3** | **F3/F4** | **F3/F5** | **F3/F6** |
| F4/F1 | F4/F2 | F4/F3 | **F4/F4** | **F4/F5** | **F4/F6** |
| F5/F1 | F5/F2 | F5/F3 | F5/F4 | **F5/F5** | **F5/F6** |
| F6/F1 | F6/F5 | F6/F3 | F6/F4 | F6/F5 | **F6/F6** |

FIG. 7a

| Bin # | Center Frequency | Bin value |
|---|---|---|
| 26 | 202.8 | 0.28 |
| 54 | 96.6 | 0.38 |
| 80 | 65.0 | 1.00 |
| 159 | 32.6 | 0.48 |

Harmonicity Matrix

| | | | | | |
|---|---|---|---|---|---|
| 1 | 2 | 3 | 6 | 0 | 0 |
| 0 | 1 | 0 | 3 | 0 | 0 |
| 0 | 0 | 1 | 2 | 0 | 0 |
| 0 | 0 | 0 | 1 | 0 | 0 |
| 0 | 0 | 0 | 0 | 0 | 0 |
| 0 | 0 | 0 | 0 | 0 | 0 |

FIG. 7b

Method 350

METHOD AND APPARATUS FOR SYNCHRONIZING AUDIO AND VIDEO COMPONENTS OF MULTIMEDIA PRESENTATIONS BY IDENTIFYING BEATS IN A MUSIC SIGNAL

BACKGROUND

1. Technical Field

Embodiments disclosed herein relate to methods and apparatus for determining the fundamental frequency (whether constant or variable) of the predominant "beat" in a musical composition and use of this information in multimedia presentations.

2. Description of Related Art

In the production of multimedia presentations, it is often desirable to synchronize music and video. Such synchronization can, however, be difficult with certain types of music.

Music composers create music with a particular tempo and a "meter." The meter is the part of rhythmical structure concerned with the division of a musical composition into "measures" by means of regularly recurring accents, with each measure consisting of a uniform number of beats or time units, the first of which usually has the strongest accent. "Time" is often used as a synonym of meter. It is the grouping of the successive rhythmic beats, as represented by a musical note taken as a time unit. In written form, the beats can be separated into measures, or "bars," that are marked off by bar lines according to the position of the principal accent.

Tempo is the rate at which the underlying time unit recurs. Specifically, tempo is the speed of a musical piece. It can be specified by the composer with a metronome marking as a number of beats per minute, or left somewhat subjective with only a word conveying the relative speed (e.g. largo, presto, allegro). Then, the conductor or performer determines the actual rate of rhythmic recurrence of the underlying time unit.

The tempo does not dictate the rhythm. The rhythm may coincide with the beats of the tempo, but it may not. FIG. 1 shows, in standard musical notation, two measures of a simple musical composition with a four-four meter, or "time signature," identified by the 4/4. This meter could also expressed as "the quarter note 'gets the beat' with four beats to a measure". The tempo will be the rate at which the quarter notes (individual solid notes in FIG. 1) recur, but in FIG. 1 the actual tempo is unspecified.

Each measure generally begins and ends with a bar line and may include an Arabic number above its beginning bar as identification. The rhythm in FIG. 1 is a steady repetition of an accented beat (indicated by ">") followed by three unaccented beats. The rate of recurrence of beats in the rhythm is the same as the tempo and each beat in the rhythm will occur on the beats of the tempo. The frequency of the accented beats in the rhythm is one-fourth of the tempo.

FIG. 2 shows three measures using the same tones ("pitches") as the notes of the musical composition in FIG. 1, but with a different meter. The meter of the musical composition in FIG. 2 is symbolized as 3/4 and expressed as "the quarter note 'gets the beat' with three beats to a measure." Here, the rhythm is a steady repetition of an accented beat followed by two unaccented beats. The rate of recurrence of beats in the rhythm is the same as the tempo and each beat in the rhythm will fall on the beats of the tempo. The frequency of the accented beats in the rhythm is one-third of the tempo.

FIG. 3 shows two measures of a simple musical composition with a 4/4 meter, with the quarter note getting the beat. Here, however, the rhythm varies in each measure. In measure 1, there are two half notes (open note equal to two quarter notes in duration), and in measure 2 there is a dotted quarter note (one and a half times the duration of a quarter note) followed by five eighth notes (each one half the duration of a quarter note). In each case, the first beat of the measure is accented followed by unaccented beats. However, the accented beats in FIG. 3 are not the same duration. Where two or more beats occur during one tempo beat period, the tempo beat is broken into appropriate sub time frames. Since in FIG. 3 the most beats per underlying time unit is two, the time unit is split into two and the time is "counted" as follows: One And Two And Three And Four And. In the second measure, the dotted quarter note is counted One And Two, the first eighth note is counted as the "And" of Two, the second eighth note as Three, the third eighth note as the "And" of Three, the fourth eighth note as Four, and the last eighth note as the "And" of Four. The And is symbolized by an addition sign, "+". For illustration, the "counted" beats of the tempo are printed below the notes in FIGS. 1-3. Thus, one can see that only some beats of the rhythm coincide with the tempo beats. Note that the frequency of the accented beats in FIG. 3 is still one-fourth the tempo.

When asking a room of people to "keep time" to the beat of a musical composition, the response may vary. With reference to the compositions of FIGS. 1-3, some may mark one beat per measure (the most accented beat in the measure, often the first beat) and some may mark a faster recurrence of beats. With respect to a musical composition like the two measures in FIG. 1, the second group of people will be marking four times to the first group's one mark in the same time period.

The fundamental beat frequency is a name given to the frequency of the predominant beats that the majority of people perceive in any given musical composition as they keep time with the music. (Note that this use of the term "frequency" is in contrast to another use of the term "frequency" to denote the pitch of a note.) Candidates for the fundamental beat frequency of the two measures of FIG. 1 could either be the tempo (number of quarter notes per minute, since all beats of the rhythm coincide with the underlying time unit) or the frequency of the accented first beat of the measure, which is one-fourth the frequency of the tempo. Candidates for the fundamental beat frequency of the three measures of FIG. 2 could either be the tempo (since all beats of the rhythm coincide with the underlying time unit) or the frequency of the accented first beat of the measures, which is one-third the tempo.

The fundamental beat frequency of the measures of FIG. 3 is unlikely to be the tempo, even though there are beats on 1 and 3 in the first measure and 1, 3 and 4 in the second measure. Candidates could be the frequency of the accented beats (one fourth of the tempo) or the frequency of beats 1 and 3 (half of the tempo). However, analysis of more measures of the composition may be necessary to determine the fundamental beat frequency.

The fundamental beat frequency may depend on other aspects of the music, like the presence, pattern, and relative strengths of accents within the rhythm. As is the case with tempo, the fundamental beat frequency is specified as beats per minute (BPM). The fundamental beat frequency in music typically ranges from 50 to 200 BPM and, of course, may change over the course of a complete composition.

Dance music has a rather pronounced and consistent fundamental beat frequency, but jazz, classical (symphonic) music, and some individual songs have inconsistent fundamental beat frequencies, because the tempo, or meter, or rhythm, or all three may change. Disc jockeys have made use of reasonably priced equipment that can detect the fundamental beat frequency of certain types of dance music, such as modern rock, pop, or hip-hop. Usually, such equipment did not identify the beats that corresponded to the fundamental beat frequency, but merely provided a tempo, e.g., 60 or 120 BPM.

A more sophisticated analyzer, unlike simpler DJ-style BPM equipment, is needed to successfully determine the fundamental beat frequency of a wider range of musical styles including jazz, classical, etc. and of material where the tempo and rhythm change, e.g. Zorba the Greek. The advent of the mathematical technique known as the discrete wavelet transform ("DWT") has enabled more precise temporal and spectral analysis of a signal. Use of the DWT has addressed some of the shortcomings of the earlier mathematical technique of Fourier transform. In particular, coefficient wavelet ("DAUB4") variations of the DWT proposed by Ingrid Daubechies, have enabled digital analysis of music with much better real-time information.

A method using DWT to analyze a musical composition to estimate the tempo is described in Section 5 "Beat detection" of the article "Audio Analysis using the Discrete Wavelet Transform" by George Tzanetakis, Georg Essl, and Perry Cook. However, this method using the DWT often failed to detect the fundamental beat frequency in certain genres of music, especially jazz and classical. The beat frequency that it did detect often did not match the beat frequency determined by human analysis using a computer (i.e., listening and clicking the mouse to the music and then averaging the time between clicks).

Due to the nature of music performance, the beats do not always fall with clock-like precision. Such imprecision and inconsistency, so that beats do not fall at exact time period intervals of the fundamental beat frequency is expected, and even desired. However, when such music is incorporated into multimedia productions, sophisticated synchronization of audio and video is necessary. That is, the eye will immediately notice if still images or moving video content is manipulated or changed at inappropriate instants in time, i.e., times not corresponding closely enough to the beat corresponding to the fundamental beat frequency, be it slightly ahead or behind the actual beat onset times. In certain audiovisual applications, it is not sufficient to merely determine the fundamental beat frequency, but rather, it is desirable to select the exact beat onset time that are associated with this fundamental beat frequency.

A time domain signal (amplitude vs. time) display of a musical composition does not always readily indicate the fundamental beat frequency. The envelope of the time domain signal can be manipulated to make the onsets of the notes of the instrument (whether it be voice, rhythm, wind, brass, reed, string, or whatever else is being used) appear as amplitude peaks. However, most of the time not all of the peaks are beat onset times that correspond to the fundamental beat frequency.

It is therefore desirable to provide improved methods and apparatus for detecting the fundamental beat frequency in a music signal and the beat onset times associated with it and incorporate of this information into production of multimedia presentations.

SUMMARY

As embodied and broadly described herein, a method of and apparatus for detecting a fundamental beat frequency in a predetermined time interval of a music signal, consistent with the invention comprises processing a music signal with the discrete wavelet transform to obtain a set of coefficients, processing a subset of the coefficients to obtain a plurality of candidate beat frequencies contained in the corresponding portion of the music signal, determining the harmonic relationships between the candidate beat frequencies, and determining the fundamental beat frequency based upon the determined harmonic relationships.

BRIEF DESCRIPTION OF THE DRAWINGS

The accompanying drawings, which are incorporated in and constitute a part of this specification, illustrate several embodiments consistent with the invention and together with the description, serve to explain the principles of the invention.

FIGS. 7*a* and 7*b* illustrate the harmonicity matrix calculations of the method of FIG. 4.

DESCRIPTION OF EMBODIMENTS

Reference will now be made in detail to the exemplary embodiments consistent with the invention, examples of which are illustrated in the accompanying drawings. Wherever possible, the same reference numbers will be used throughout the drawings to refer to the same or like parts.

Figure 4:
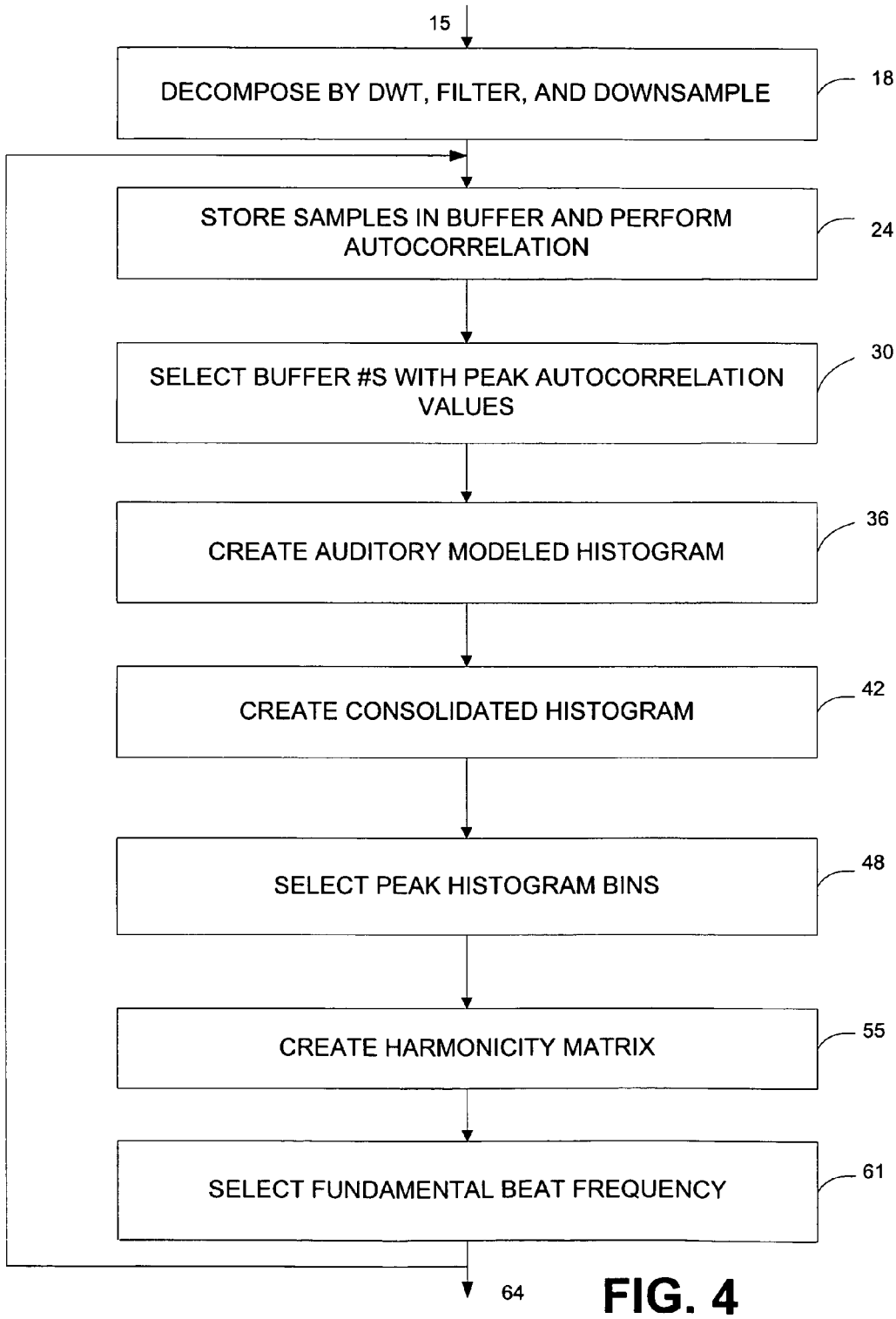
FIG. 4 is a flow diagram of a method consistent with the invention for detecting the fundamental beat frequency in a window of time in a music signal.

A method consistent with the invention detects the fundamental beat frequency present in a localized section of a music signal. In FIG. 4, a digital music signal 15 is transformed using the DWT plus other digital processing in stage 18. Preferably, signal 15 has a sample rate of 22.05 kHz and represents audio frequencies up to 11.025 kHz. Signal 15 is processed by a Dyadic Analysis Filter Bank ("DAUB4"), a well-known specific application of DWT, to produce five sets of DWT coefficients. Specifically, a set of "Detail" coefficients is produced corresponding to four separate octave subbands with upper limits at 11,025 Hz, 5,512 Hz, 2,756 Hz and 1,378 Hz; and a set of "Smooth," or coarse approximation, coefficients is produced for the band from zero to 689 Hz. Other input frequencies or wavelet families may be used; however, this works well to identify the beat for a variety of instruments.

The coefficient sets from DAUB4 are further digitally processed in stage 18. Specifically, the subband Detail coefficient sets and the Smooth coefficient set are full wave rectified and low-pass filtered by, for example, a second-order Butterworth low-pass filter with a cutoff frequency of approximately 120 Hz. This cutoff frequency is a compromise in that it is necessary to capture the envelope of each of the bands and preserve the rhythmic content while protecting against aliasing in the downsampling that follows.

The processed coefficient sets are then downsampled to a common sample rate, preferably of approximately 86 Hz. Specifically, the coefficient set for the highest frequency band is downsampled by a factor of 128. The coefficient set for the next highest frequency band is downsampled by half as much, that is, a factor of 64. Coefficient sets for the lower two frequency bands are downsampled by factors of 32 and 16, respectively. The coefficient set for the coarse approximation is also downsampled by a factor of 16. The downsampled data of all subbands and the downsampled coarse approximation are summed.

Stage 24 processes the summed data by high pass filtering and assembling into buffers each containing summation values, preferably 256 summation values. Since input signal 15 had a sampling rate of 22.05 kHz, 256 summation values, after downsampling to a common sampling rate of approximately 86 Hz, represents approximately three (3) seconds of audio, specifically, 2.9722 seconds. The buffer size is chosen to encompass several cycles of the expected range of the fundamental beat frequency. Because most music typically has a fundamental beat frequency of 50 to 200 BPM, a time interval of three seconds of audio is likely to contain at least three beats at the fundamental beat frequency.

Each buffer entry represents 1/256 of 2.9722 seconds of audio, or 11.6 ms. Beat periodicity resolution is therefore 11.6 ms or, in other words, has an absolute uncertainty of 11.6 ms.

Each successive buffer is created such that its set of summation values overlaps with the previous buffer's set. In this embodiment, the overlap is 128 summation values. That is, the first 128 summation values of each buffer are the same as the last 128 summation values of the previous buffer. The overlap may be greater or smaller. The overlap does not affect the sample rate of subsequent processing but does alter the amount of processing. With an overlap of 128 summation values, the analysis moves forward in 1.486 second hops. With an overlap of 192 summation values, for example, the analysis would move forward in 0.743 second hops.

Greater overlap provides greater time resolution for beats. In other words, with a 192 summation value overlap, three fourths of each 2.9722 seconds of audio would be analyzed at least twice, the latter half would be analyzed three times, and the last fourth would be analyzed four times. Thus, the window of time for a particular beat representing a detected beat period is narrowed, providing a greater time resolution, or certainty, as to when the beat marking the beginning of that period will occur.

Figure 5:
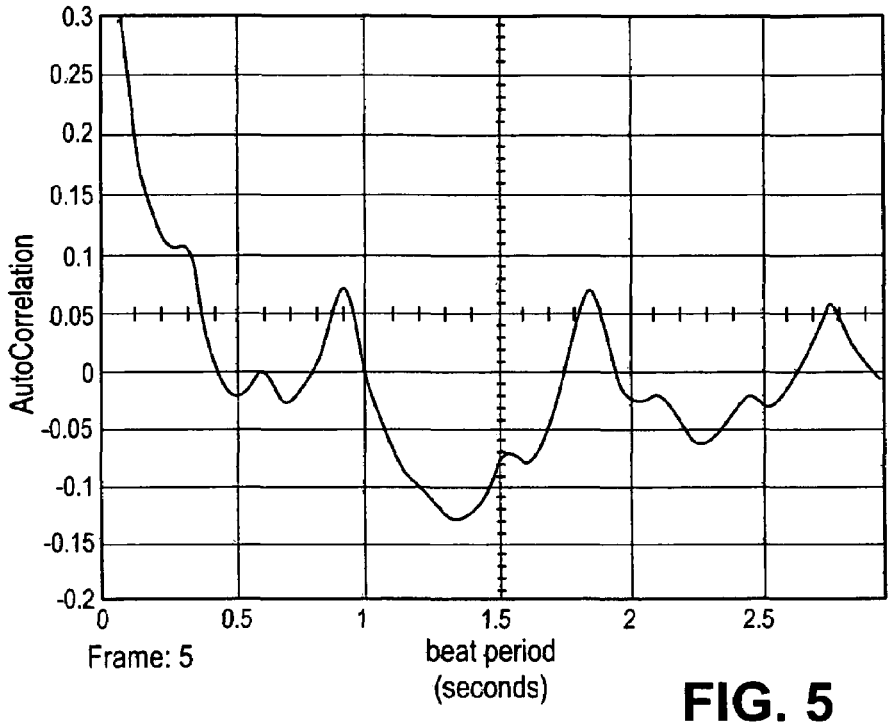
FIG. 5 is a graph of an envelope of a sample autocorrelation function as a function of beat period.

The autocorrelation function for the buffer is then sequentially computed with all non-negative lags and normalized, creating an autocorrelation value for each entry in the buffer. An aggressive high pass filter then performs mean removal, i.e., removes the autocorrelation values for very small time shifts. An envelope of autocorrelation data for the buffer, when graphed as a function of beat period (in seconds) is illustrated in FIG. 5.

As illustrated in Table 1 below, each buffer entry corresponds to a range of beat period in seconds and a range of frequencies in beats per minute.

TABLE 1

| buffer entry # | maximum frequency (BPM) | minimum beat period (seconds) | minimum frequency (BPM) | maximum beat period (seconds) |
|---|---|---|---|---|
| 1 | undefined | 0.0000 | 5168.0 | 0.0116 |
| 2 | 5168.0 | 0.0116 | 2584.0 | 0.0232 |
| 3 | 2584.0 | 0.0232 | 1722.7 | 0.0348 |
| . . . | . . . | . . . | . . . | . . . |
| 57 | 92.3 | 0.6502 | 90.7 | 0.6618 |
| 58 | 90.7 | 0.6618 | 89.1 | 0.6734 |
| 59 | 89.1 | 0.6734 | 87.6 | 0.6850 |
| . . . | . . . | . . . | . . . | . . . |
| 90 | 58.1 | 1.0333 | 57.4 | 1.0449 |
| 91 | 57.4 | 1.0449 | 56.8 | 1.0565 |
| 92 | 56.8 | 1.0565 | 56.2 | 1.0681 |
| . . . | . . . | . . . | . . . | . . . |
| 175 | 29.7 | 2.0201 | 29.5 | 2.0317 |
| 176 | 29.5 | 2.0317 | 29.4 | 2.0434 |
| . . . | . . . | . . . | . . . | . . . |
| 255 | 20.3 | 2.9489 | 20.3 | 2.9606 |
| 256 | 20.3 | 2.9606 | 20.2 | 2.9722 |

In stage 30 of FIG. 4, the autocorrelation values are processed to identify the most prominent peaks of the autocorrelation function within a range of buffer entry numbers, preferably numbers 25 to 130. The preferable range selected covers the expected normal range of music fundamental beat frequencies between 50 and 200 BPM. The higher the autocorrelation value in these buffer entry numbers, the more likely that the corresponding time represents the fundamental beat period.

Specifically, to emphasize positive correlations, the autocorrelation values are first half-wave rectified. The maximum value and average noise value of the rectified autocorrelation values of the current buffer are determined. The autocorrelation values are examined for a positive change greater than the noise level to indicate the start of a peak. The data is examined to find the turnover point, that is, the largest buffer entry number whose autocorrelation value increases after start of peak. The buffer entry number and the autocorrelation value at the turnover point is logged. A threshold is applied to eliminate smaller peaks. In this embodiment, 20% of maximum peak value is the threshold.

Selecting only the highest peaks of the autocorrelation function for further analysis serves the purpose of decreasing the data that needs to be further analyzed, thus saving computational time. If limiting the computational time is not important in a particular application, then the threshold to eliminate smaller peaks need not be performed. Also an alternate peak-picking method could be employed rather than the specific one described above. The output of stage 30 is a set of 256 values corresponding to buffer entry numbers, of which all are zeroes, except those corresponding to buffer entry numbers of the identified autocorrelation peaks.

Next, in stage 36, the peak values from stage 30 are integrated and stored in corresponding "bins" of a dynamic and weighted histogram. The histogram has 256 bins, each corresponding to a buffer entry number. Integration is performed to increase the ability of the method to identify those beat frequencies that a human being would perceive while listening to the music as it progresses. Stage 36 does this by considering and recording not only that a particular beat frequency was present in the three seconds of music represented by the buffer, as indicated by the identified autocorrelation peaks of the buffer currently being processed, but by allowing those identified frequencies to affect the accumulated record of frequencies identified by autocorrelation peaks of previous buffers' data.

Specifically, if a beat frequency is present in the current buffer (as indicated by a non-zero autocorrelation peak value), the peak value is multiplied by an integration value and added to any value currently stored in the corresponding bin.

In stage 36, the bin value can thus increase over processing intervals of successive buffers, up to a maximum value of 1.0. On the other hand, if a beat frequency is not one of the highest autocorrelation peaks in the currently processed buffer, the corresponding value passed from stage 30 is zero, and then the integration value is subtracted from the corresponding bin value.

Figure 6:
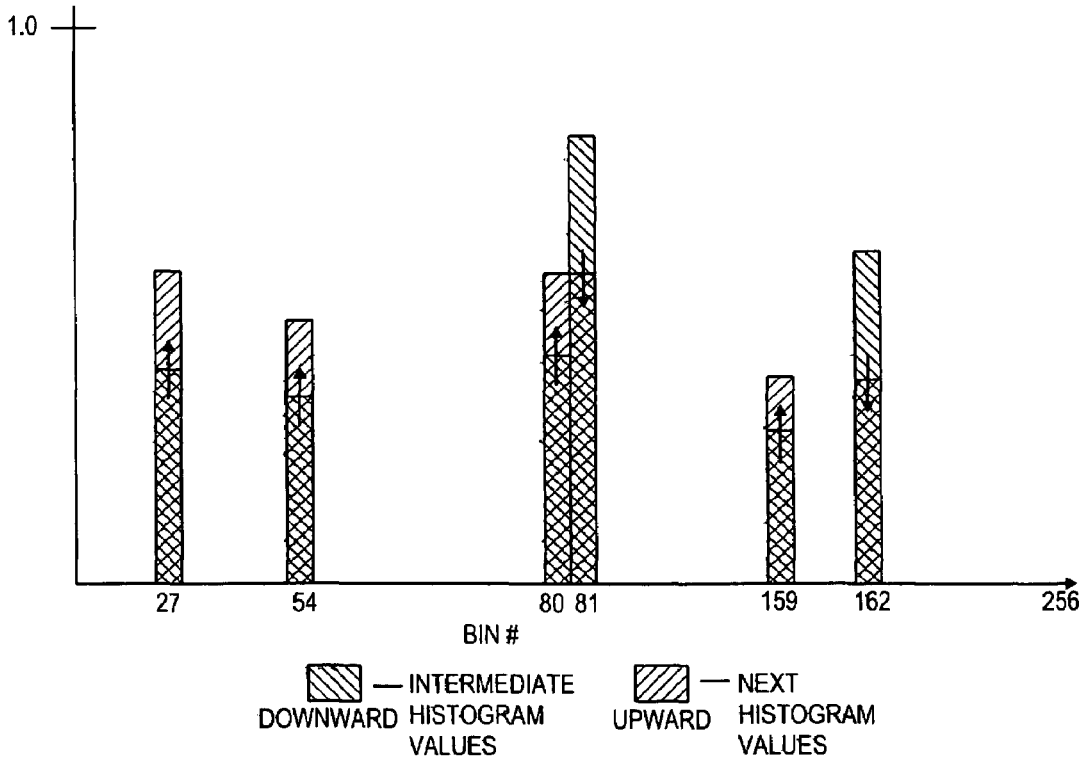
FIG. 6 is a sample histogram showing two successive results from the method of FIG. 4.

FIG. 6 shows a sample histogram and illustrates the effects of a shift in tempo. In this example, the tempo is increasing. Thus, whereas autocorrelation peaks had previously been present at frequencies corresponding to buffer entries 27, 54, 81, and 162, thus building the values in histogram bins 27, 54, 81, and 162, the autocorrelation peaks of several subsequent and the current buffers are present in frequencies corresponding to buffer entries 27, 54, 80, and 159. The values in the histogram bins 81, and 162 are thus decreased by the integration value and the values in the histogram bins 27, 54, 80, and 159 are increased by the most recent (non-zero) peak autocorrelation value multiplied by the integration value. Thus, the histogram of FIG. 6 differs from a standard running histogram that will only increase the value in any peak frequency bin by one count for each time a peak in the same autocorrelation bin number appears in the next buffer's data.

The integration value chosen controls how quickly the values in the bins for the detected beat frequencies in the histogram build and decay. Preferably, the integration value is 0.1. The integration value is an important variable and, combined with the low pass filters in stage 18 (preferably second-order Butterworth filters) after the DAUB4 wavelet analysis, determines the ability to track changes of tempo.

A particularly strongly-accented and recurring beat will produce a large magnitude peak in the autocorrelation function, and if it recurs with great regularity (i.e., appears in almost every buffer of processed data), the corresponding histogram bin value will build quickly to a maximum value of 1. If the musical signals to be analyzed will always have an extremely stable beat, then a "fast" value of 0.2 for the integration value is appropriate, because it will build and decay the histogram bin value faster. It should be noted that a normalized histogram (values between zero and one) is used solely for ease of processing and it is not necessary to set maximum values of 1.

Returning to FIG. 4, at stage 42, the mathematical technique known as a sliding window function is used to consolidate the values in adjacent bins for a subsequent peak detection function. Preferably the window function is a Hamming window function. However, those skilled in the art will recognize the particular benefits and applications for other window functions, for example, Blackman, Barlett, Kaiser, Hanning, or Triangular. The window function serves to capture the effects of the bins in the middle of the window, but to stop the effects of values in bins at the edges, or in other words, to prevent "leakage."

This way, if the tempo is changing, the shift in prevalent frequencies will not mask the peak beat frequencies due to two adjacent bins having similar magnitudes. Since the peak-picking operation in stage 30 operates by moving from left to right in the autocorrelation data, use of the sliding window function will particularly assist in identifying the beat frequencies if the tempo is increasing, because the peaks will shift to the left in the autocorrelation function as the beat periods become shorter and therefore will not be selected as a candidate for predominant beat frequency until its value in the histogram rises above the previous peak frequency, which, even though it is decaying, will still have significant magnitude.

Referring back to FIG. 6, when the histogram values have the upward-hatched values, bins 80 and 81 have the same value. Therefore, without the window function, bin 81 would be the turnover bin. Yet the peaks in the buffer no longer are present at bin 81, but rather at bin 80. Thus the frequency corresponding to bin 80 should be considered as a candidate frequency and not the frequency corresponding to bin 81.

In stage 48 (FIG. 4), the resulting histogram produced by the window function is examined and the peaks (local maximum amplitude bin values) are identified, preferably the six highest. The peak picking method of stage 30 may be used, but this is not necessary. The number of peaks chosen also is not critical. However, because the fundamental beat frequency has relationships with other prevalent beat frequencies present, more than one peak should be chosen. At this point, the beat frequencies corresponding to the selected peaks are candidates for the fundamental beat frequency. The selected peak bin numbers and values are then used to form a harmonicity matrix at stage 55.

Figure 1:
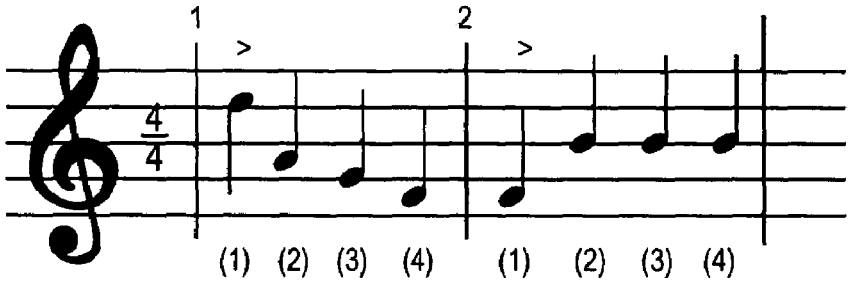
FIG. 1 shows standard musical notation of two measures of a simple music composition in four-four time.
Figure 2:
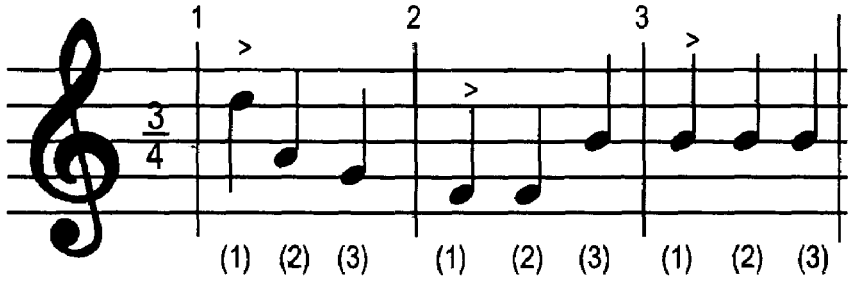
FIG. 2 shows standard musical notation of three measures of a simple music composition in three-four time.
Figure 3:
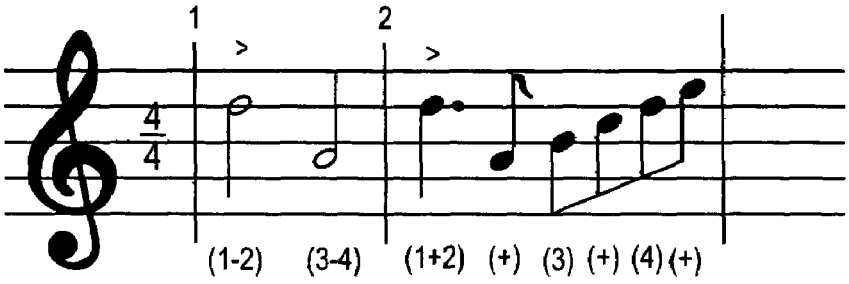
FIG. 3 shows standard musical notation of two measures of a second simple music composition in four-four time.

With reference back to FIG. 1, the accented beat (beat 1, indicated by the ">") recurs at a frequency, X. Beats 1 and 3 of each measure recur at frequency 2×. Beats 1 and 2 of each measure recur at frequency 4×. The mathematical relationships between them may be expressed by the term "harmonic," a term which is also used in relation to pitch. Although the accented beat frequency X is too low to be audible, it does have harmonic relationships with the other prevalent beat frequencies.

True harmonics, of course, consist of only whole integer multiples of a frequency. However, because the beat frequencies corresponding to the histogram bins each actually represent a range of beat frequencies (the beat periodicity value has an uncertainty of 11.6 ms), and because the exact time period between beats may be shortened or lengthened in a performance of a musical composition, methods consistent with the invention consider candidate beat frequencies to be harmonics of each other even when the ratio of such beat frequencies is not a precise integer.

In stage 55 (FIG. 4), a harmonicity matrix is constructed. Specifically, the harmonic relationships between beat frequencies of the six peaks of the histogram of FIG. 6, ordered from highest to lowest beat frequency, are determined and entered into a matrix. These beat frequencies F1 through F6 are candidates for the fundamental beat frequency.

FIG. 7*a* illustrates the six beat frequencies F1 through F6, where F1>F2>F3>F4>F5>F6. The first column at the left of FIG. 7*a* contains bin numbers corresponding to the beat frequency and the third column contains the values stored in the corresponding histogram bins, represented by RA1 through RA6. Each of the frequencies F1-F6 could represent any of the beat frequencies in the range of beat frequencies corresponding to a specific bin number, for example, the maximum beat frequency of each bin number, the minimum beat frequency, or the center beat frequency. In this example, we will use the center beat frequency.

Next, the harmonic relationships between the candidate beat frequencies are found. FIG. 7*a* illustrates the mathematical formulas represented by each cell of the matrix. Although FIG. 7*a* indicates that ratios of beat frequencies are entered into cells of the matrix, the actual matrix entries are not always equal to exact ratios. Rather, each entry is the whole integer (greater than one) nearest to the exact ratio, if the actual ratio is within a deviation value of that nearest whole integer. In this embodiment the deviation value is 7.5%.

If the exact calculated ratio between candidate beat frequencies is not within 7.5% of an exact integer, then no harmonic relationship between the two candidate beat frequencies is found, and a zero is thus entered into the corresponding cell of the matrix. On the other hand, if the calculated ratio is within 7.5% of an integer, then that integer is entered into the matrix, representing the harmonic relationship between the two candidate beat frequencies. Stage 61 (FIG. 4) uses the harmonic relationships between candidate beat frequencies and their relative amplitudes (values from the peak bin numbers passed to stage 61 from stage 55) of the candidate frequencies to select a fundamental beat frequency.

When the harmonicity matrix is completed, it is used by stage 61 to determine the fundamental beat frequency. Preferably, the fundamental beat frequency is determined as follows. The matrix shows the harmonic structure of the candidate beat frequencies in the selected bins. For example, the top row of the matrix of FIG. 7*b* corresponds to bin 26, representing candidate beat frequency F1 of 202.8 BPM, and contains the numbers 1, 2, 3, and 6. This indicates that this candidate beat frequency, F1, constitutes the first, second, third, and sixth harmonic of candidate beat frequencies contained in the music represented by this set of histogram values, but the frequencies of which it is the fourth and sixth harmonic are missing. Therefore, the harmonic structure is non-contiguous and is considered to be ambiguous with respect to candidate beat frequency F1. Non-ambiguous harmonic structure means, in other words, no missing harmonics.

The second row of the matrix represents candidate beat frequency F2. This row contains a 1 and a 3. Thus, candidate beat frequency F2 constitutes the first and third, but not the second harmonic of candidate beat frequencies contained in the music represented by this set of histogram values. Thus the harmonic structure of F2 is also ambiguous.

The third row represents candidate beat frequency F3 and contains a 1 and a 2, indicating first and second harmonics. Since 1 and 2 are contiguous, candidate beat frequency F3 has contiguous harmonics and is considered to have a non-ambiguous harmonic structure. The fourth row for candidate beat frequency F4, contains only a 1. The harmonic structure of F4 is also considered to be non-ambiguous. Thus the candidates for the fundamental beat frequency are narrowed to frequencies F3 and F4, that is, those that have non-ambiguous harmonic structures. Stage 61 then selects the candidate beat frequency with the largest relative amplitude and a non-ambiguous harmonic structure as the fundamental beat frequency.

In FIG. 7*b*, candidate beat frequency F3, bin 80, has the largest relative amplitude (1.00) and a non-ambiguous harmonic structure. Since each bin actually represents a range of frequencies, the fundamental beat frequency for this example is between 64.6 and 65.4 BPM.

In an alternative embodiment, the resolution of the selected fundamental beat frequency may be improved by multiplying the frequency range of the highest bin number in the harmonic structure of the fundamental beat frequency by the harmonic number of the fundamental beat frequency. In FIG. 7*b*, the highest bin number in the harmonic structure of the fundamental beat frequency is bin number 159. Its corresponding frequency range is 32.5 to 32.7 BPM. Multiplying this frequency range by the harmonic number of the selected fundamental beat frequency (i.e., 2) yields 65.0-65.4 BPM, a better resolution of the fundamental beat frequency than 64.6-65.4 BPM, which is the frequency range of bin 80. This fundamental beat frequency range of 65.0-65.4 is the output of stage 61 in the embodiment.

Optionally, the relative strength of each beat, as measured as the sum of the relative amplitudes (RA) of all found harmonics may also be calculated. This can be useful as a classification tool for database searches, e.g., "search for all dance music" would select a certain range of BPM and a strength of beat exceeding a desired level.

As shown in FIG. 4, this process returns to stage 24 and repeats for each 256-summation value buffer, until all buffers of signal 15 have been processed. The method thus creates a series of fundamental beat frequency values.

Figure 8:
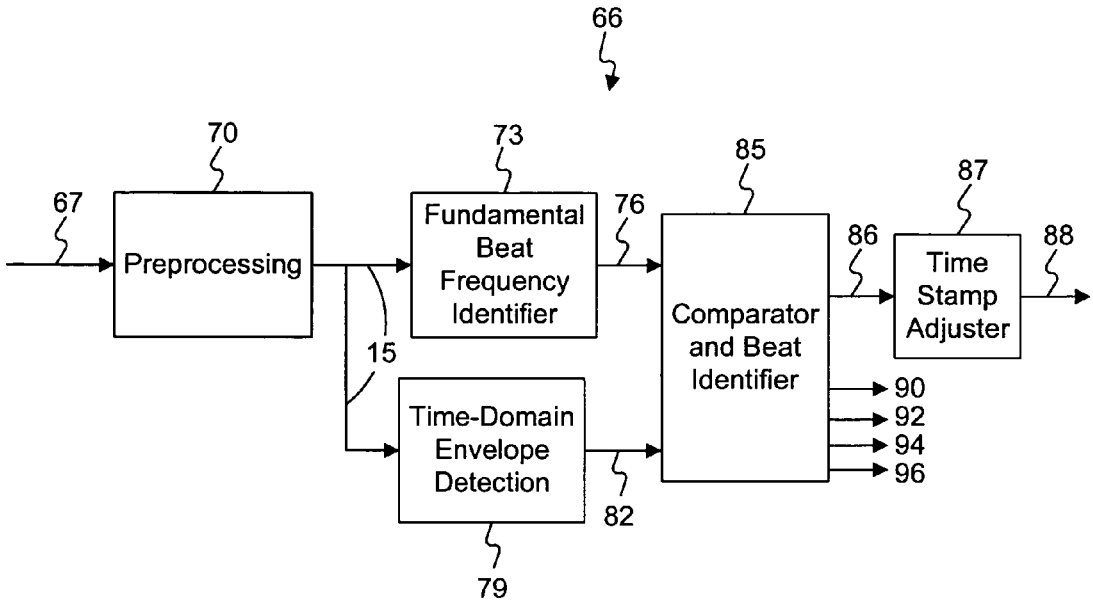
FIG. 8 is a block diagram of a beat analyzer consistent with the invention for identifying the onset time and amplitude of beats corresponding to a fundamental beat frequency of a music signal.

Illustrated in FIG. 8 is a beat analyzer 66 consistent with the invention. Here, a music signal 67, which may have any number of channels and any sampling rate, is converted by a pre-processor 70 to a mono-channel music signal 15, preferably sampled at 22.05 kHz. Signal 15 is processed by a fundamental beat frequency identifier 73, which may execute the method described above to produce a signal 76 consisting of a series of fundamental beat frequency values for successive time intervals of music signal 67.

Signal 15 is also processed by a time domain envelope peak detector 79 to produce a fast-attack, slow-release peak time-domain envelope signal 82. The fast-attack, slow-release peak detector 79 accurately detects amplitude peaks, but does not have the intelligence to know which peaks correspond to the fundamental beats. The time constants used in this embodiment of detector 79 are zero for attack and 0.75 seconds for release, but this is not critical.

Fundamental beat frequency signal 76 and envelope signal 82 are supplied to a comparator and beat identifier 85. Comparator and beat identifier 85 employs a phase-locked loop to select the peaks in envelope signal 82 which correspond to beats corresponding to fundamental beat frequency values of signal 76. Specifically, a time delay compensator is used in comparator and beat identifier 85 to align envelope signal 82 with time periods based on fundamental beat frequency values specified by signal 76, since it takes more time for signal 15 to be processed by fundamental beat frequency identifier 73 than detector 79. Comparator and beat identifier 85 selects only the maximum peaks of envelope signal 82 that are within time periods based on fundamental beat frequency values of signal 76, thus removing non-relevant peaks from consideration as beats corresponding to fundamental beat frequency values of signal 76.

Figure 9:
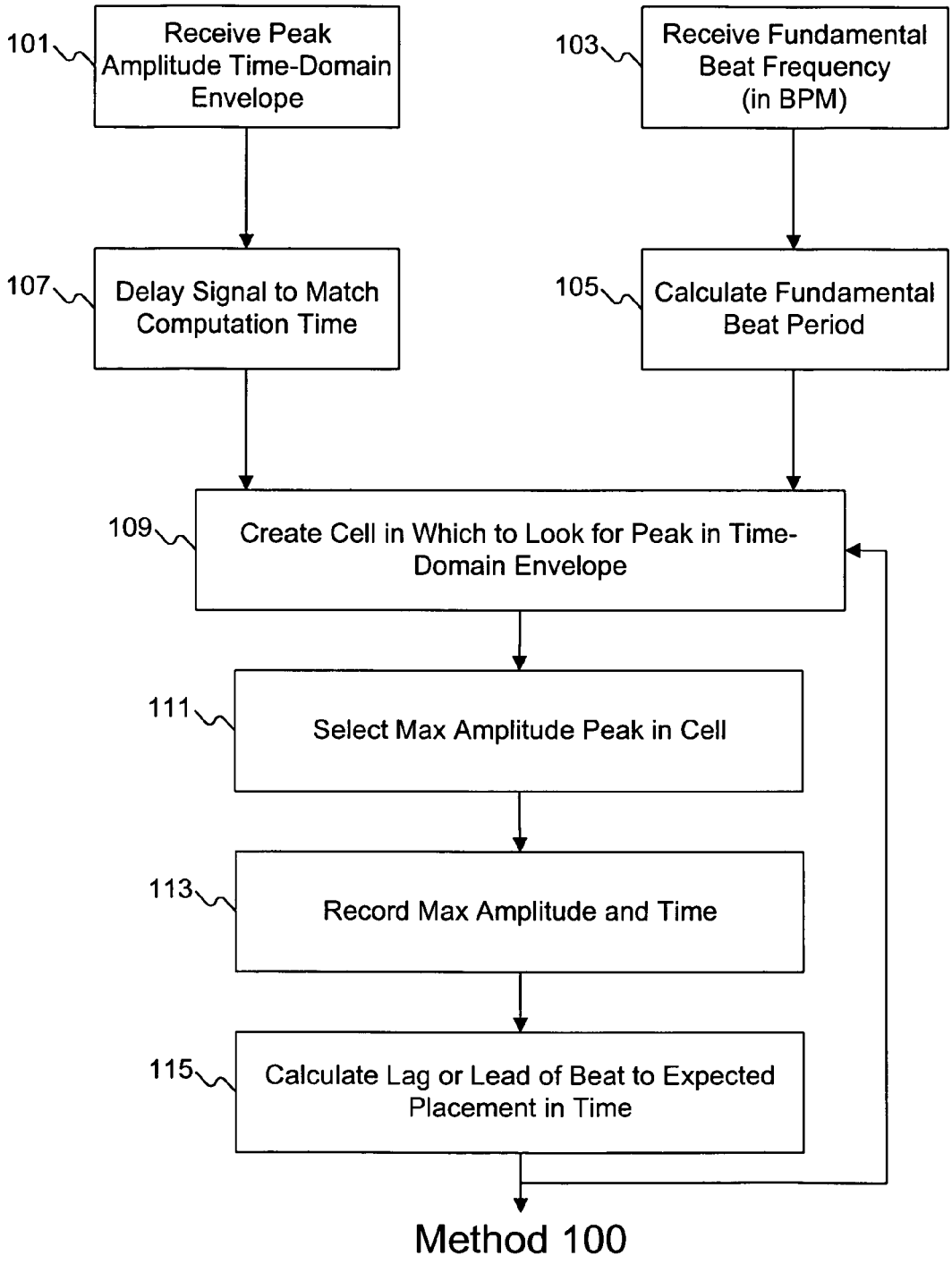
FIG. 9 is a flow diagram of a method consistent with the invention for identifying the time of occurrence and amplitudes of peaks in a time domain envelope signal which correspond to a fundamental beat frequency of a music signal.

FIG. 9 illustrates a method 100 for identifying fundamental beat onset times and amplitudes of music signal 15, by which comparator and beat identifier 85 may operate. Method 100 receives envelope signal 82 in stage 101, and fundamental beat frequency signal 76 in stage 103. In stage 105, method 100 repeatedly calculates a fundamental beat period, which is proportional to the inverse of current received fundamental beat frequency values of signal 76. The proportion depends on the time units in which fundamental beat frequency 76 is expressed and the desired time units of the fundamental beat period. In stage 107, envelope signal 82 is delayed to compensate for the length of time it takes to receive signal 76 and calculate the fundamental beat period of each fundamental beat frequency value of signal 76. Stages 101/107 and 103/105 may proceed sequentially or in parallel.

Figure 10A:
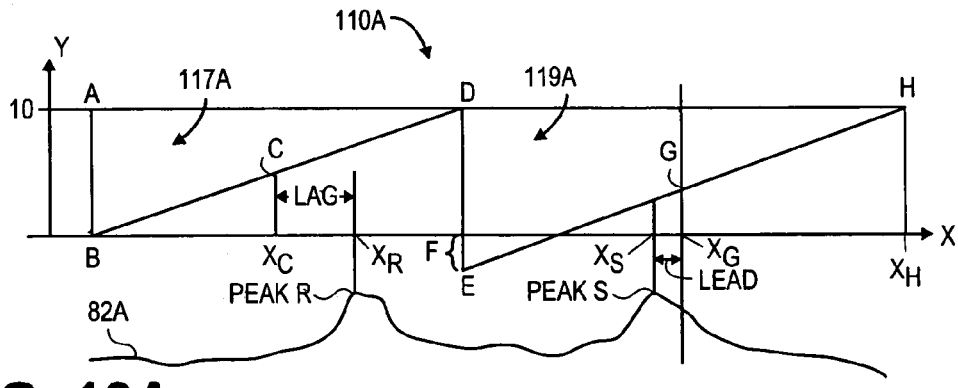
FIGS. 10*a-c* are example cell grids constructed in relation to sample time domain envelope signals in connection with the method of FIG. 9.
Figure 10B:
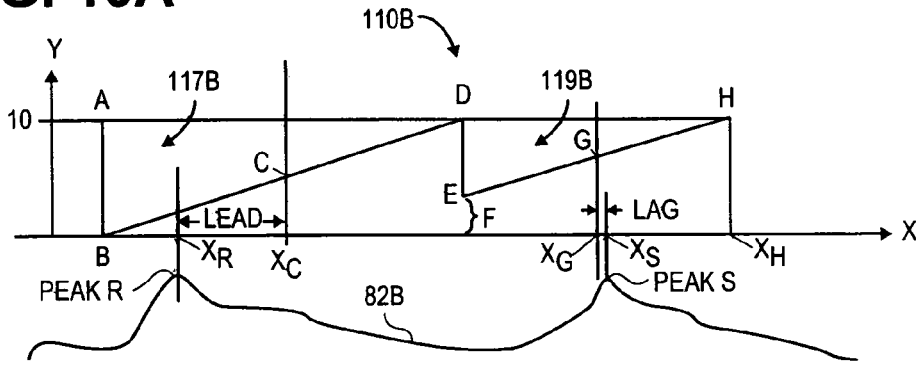
Figure 10C:
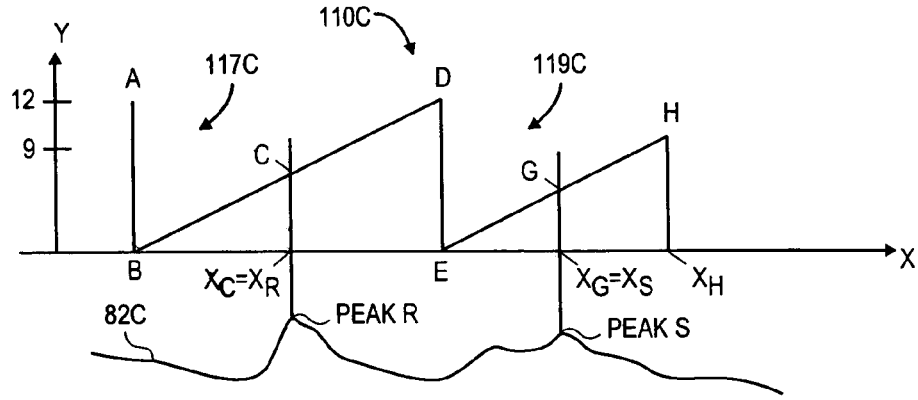

Stage 109 selects a portion of envelope signal 82 corresponding to a "cell" or period of time in which to search for peaks corresponding to the fundamental beat frequency. In general, it may construct a grid of cells based on fundamental beat periods, as shown in FIGS. 10*a*-10*c*. Each cell length is initially approximately equal to the actual fundamental beat period, because the fundamental beat frequency value received in stage 103 is only an estimate (picked from the range of frequencies present in each "frequency bin" as illustrated in Table 1) and because the positively sloped line is created by a series of small steps, which are dependent on the sampling rate, the maximum Y value and corresponding end X value of each cell will have a small error of 2 to 3%. Each cell may be constructed in real time (at the same time envelope signal 82 is received) to place the middle of the cell over the expected beat onset. This makes it easier to select peaks corresponding to beat onsets, for if the edge of the cell were to occur where the peak was expected, two peaks might appear in the cell, or none. The middle of the cell indicates the expected placement in time of the maximum peak (beat onset) in envelope signal 82.

However, the maximum peak in each cell may not occur exactly at the expected time. Because each cell is based on the fundamental beat period, no matter where the maximum peak is within the current cell of the cell grid, it is selected in stage 111 and the elapsed time and amplitude are recorded in stage 113. If the maximum peak in the first cell did not occur at the expected time within a cell, then the difference in time between the expected time and the maximum peak is calculated in stage 115. If the maximum peak occurred before the expected time, the difference is described as a lead time, i.e., the actual beat onset leads the expected placement and the actual beat period is shorter than the calculated fundamental beat period. On the other hand, if the maximum peak occurred after the expected time, the difference is described as a lag time, i.e., the actual beat onset lags the expected placement and the actual beat period is longer than the calculated fundamental beat period.

Method 100 uses the lead or lag time as an error signal to calculate the length of the next cell in which to look for a peak in envelope signal 82 corresponding to the fundamental beat frequency. FIGS. 10*a, b*, and *c* illustrate a manner in which stages 109-113 may operate. In each of FIGS. 10*a*-*c*, envelope signal 82 is shown in relation to a cell grid 110 constructed on an x-axis representing time. The y-axis is unitless, but is proportional to the fundamental beat period as expressed minutes. Cell grid 110 is composed of vertical line-segments and positively-sloped line segments, such as AB, BD, DE, EH, and HI. The slope of each positively-sloped line segment is equal to a multiple of the fundamental beat frequency. It is not critical which multiple is selected. However, the selected multiple determines the y-value of point A.

In FIGS. 10*a*-*c*, the first cell 117, composed of vertical line segment AB and positively sloped line segment BD, is constructed such that the peak is expected to occur at the midpoint of segment BD, point C, at time Xc. Point B and point E are a fundamental beat period apart, thus Xc is one-half a fundamental beat period further in time than point B. A peak in envelope signal 82, which corresponds to a beat onset of a beat in the music of signal 67, is expected at time Xc. Envelope signal 82 is examined and the maximum peak between points B and E is selected in stage 111. The maximum peak between points B and E is peak R. The time and amplitude of peak R from time envelope signal 82 is recorded in stage 113. Then, in stage 115, the difference in time between the expected time, Xc and the actual time, Xr, is calculated. In FIG. 10*a*, because peak R came later than expected, the difference is a lag time.

The difference in time is used by stage 109 to adjust the expected time of the next peak. The preferred method of adjustment follows. The difference is compared to a deviation value equal to a predetermined fraction of the length in time of the cell. Preferably, the fraction is one sixth. If the absolute value of the difference is less than or equal to the deviation value, then no change is made to the next cell's length and the next sloped line segment restarts at zero on the y axis. If the absolute value of the difference is greater than the deviation value, then stage 109 adjusts the next cell's length. If, as in FIG. 10*a*, the difference is a lag time then the next cell is lengthened by a predetermined fraction. If, as in FIG. 10*b*, the difference is a lead time then the next cell is shortened by a predetermined fraction. This is accomplished on cell grid 110 by either extending the vertical line-segment downward by a percentage of the maximum Y value, F, for a lag situation as illustrated in FIG. 10*a*, or shortening the vertical segment DE by the same percentage of the maximum Y value, F, for a lead situation as illustrated in FIG. 10*b*. Positively-sloped segment EH begins to build wherever vertical segment DE ends and continues until it reaches the maximum Y-value associated with the current fundamental beat frequency, 10, in each of FIGS. 10*a* and *b*. If the fundamental beat period as calculated in stage 105 remains the same, then the maximum value of y in each sloped line-segment always remains the same, but the minimum value of y in each cell may change.

This method of adjustment will reduce the number of incorrect peaks that are selected as peaks corresponding to beat onsets of the fundamental beat frequency from a method of no adjustment. The predetermined percentage is called the slew rate. The greater the slew rate (for FIGS. 10*a*-10*c*), the faster the cell length can react to correct for peaks not near the expected time, but the greater chance that a "false" peak will throw off the rest of the cells, destabilizing the cell length. The lesser the slew rate, the slower the cell length can react to correct for peaks not near the expected time, but the cell length will be more stable. Preferably the slew rate is 15 percent. Other percentages could be used. Alternate methods of adjustment could also be used.

As illustrated in FIG. 10*c*, if the fundamental beat frequency value of signal 76 as calculated by identifier 73 changes, the maximum y-value attained will either be greater (for smaller fundamental beat frequencies) or lesser (for greater fundamental beat frequencies). Specifically, in FIG. 10*c*, the fundamental beat frequency in cell 117*c* is 60 BPM, and for cell 119*c*, it is 80. Because the slope of segments BD and EH remains the same (12×60=720), the maximum Y-value attained in cell 119*c* is 9, where as it was 12 in cell 117*c*.

Returning to FIG. 10*a*, cell 119*a* is longer than cell 117*a*, as a result of the lag between Xr and Xc being more than one-sixth of the length of cell 117*a*. Point G is the midpoint of segment EH and its x value, Xg, marks the expected placement in time of the next peak corresponding to a beat onset. The maximum peak between Xe and Xh is peak S, which leads Xg, but only by an amount less than one-sixth of the length of cell 119*a*. Therefore no adjustment is made to the length of the next cell. The process repeats.

In FIG. 10*b*, peak R leads Xc in cell 117*b*. The adjustment for the lead shortens segment DE by F, and moves Xg up in time (to the left) in cell 119*b*. Peak S, the next selected peak, lags the adjusted expected time, Xg, but is again within one-sixth of the length of cell 119*b* and no adjustment of the next cell length is needed.

In FIG. 10*c*, peak R coincides in time with midpoint Xc, thus no adjustment to the length of cell 119*c* is needed. However, the fundamental beat frequency identifier 73 determined a change in fundamental beat frequency 76 from 60 to 80 (this is for example only), and thus cell 119*c* is shorter than cell 117*c*. However, peak S coincides with midpoint Xg, so, again, no adjustment to the next cell length is needed.

Returning to FIG. 8, comparator and beat identifier 85 produces several outputs. The first is a series of time values 86 from each of the selected peaks in envelope signal 82. A final stage 87 generates a time-stamp for each of the time values 86, adjusting for the processing delay and time delay compensation in comparator and beat identifier 85. The series of time-stamps corresponds to the beat onset times of signal 67 and is called the tempo grid 88. A second output is the series of amplitudes corresponding to the signal strengths 90 from each of the selected peaks in envelope signal 82.

Several outputs in addition to the series of beat onset times 88 and signal strengths 90 of the beats in the music signal 67 may be provided. These additional outputs may include: a numeric indication 92 of the current fundamental beat frequency in the range 50 to 200 BPM; a beat graph 94, which is a graphical indication of the relative strength of each beat, i.e., an indication of the overall strength of the beat as the material progresses; a beat per minute graph 96, which is a graphical indication of the BPM. BPM graph 96 could be superimposed on a video screen as an aid to karaoke singers. Each of these outputs has values during operation of method 100, i.e., they may be created in real time, not only after the entire envelope signal 82 has been processed.

It should be noted that the above described embodiments may be implemented in software or hardware or a combination of the two.

Figure 11:
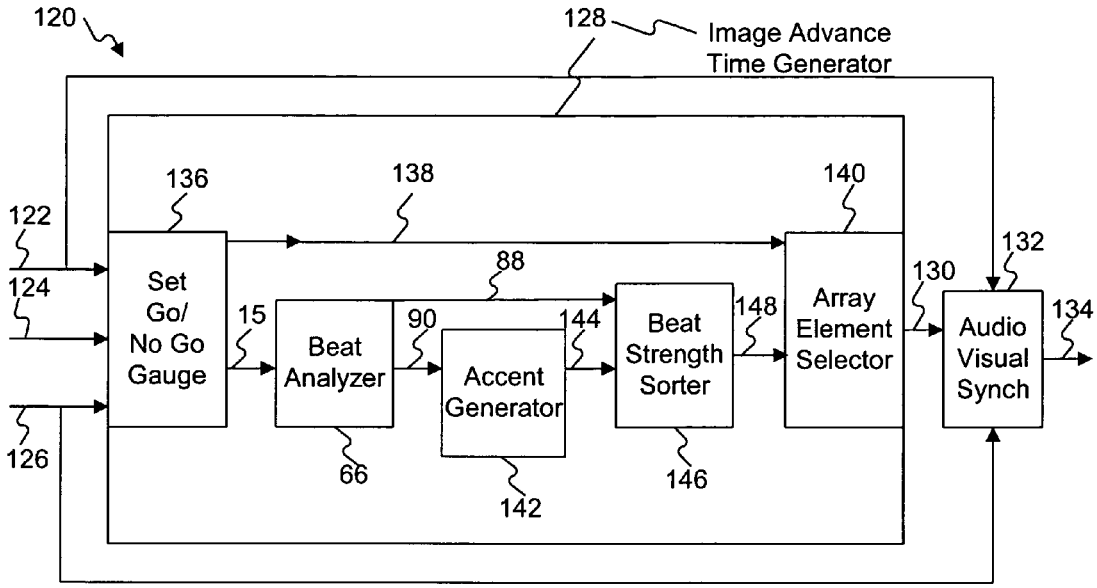
FIG. 11 is a block diagram of a still image advance synchronizer consistent with the invention.

In another embodiment consistent with the invention, the data produced by beat analyzer 66 is used by an automatic slideshow synchronizer 120, illustrated in FIG. 11, that automatically generates signals to display still images synchronized to music. In FIG. 11, automatic slideshow synchronizer 120 receives a set of still images 122, a user-entered minimum display period per image ("MDP") 124, and a music signal 126 as inputs to an image advance time generator 128. MDP 124 is the minimum amount of time that the user wishes any single image to be displayed. However, in applications where the slide show will be saved to a DVD, the MDP preferably is no less than 1.0 second. Image advance time generator 128 produces an array of beat elements 130, each of which specifies the time at which the next still image in set 122 should be displayed to synchronize the image change with the onset of a predominant beat in music signal 67. An audiovisual synchronizer 132 generates an audiovisual signal 134 from inputs 122, 126, and 130, which comprises an electronically-timed slide-show such that the still images of signal 122 advance in synchronization to predominant beats of music signal 126.

As illustrated in FIG. 11, image advance time generator 128 comprises a set go/no-go gauge 136. Gauge 136 supplies a signal 138, specifying a workable number of images to be displayed, to an array element selector 140. Gauge 136 also supplies a signal 15, comprising a workable set of music data, to beat analyzer 66. Beat analyzer 66 may function as described in the previous embodiment and passes a set of beat onset times 88 to a beat strength sorter 146 and a set of corresponding beat amplitudes 90 to an accent generator 142. Accent generator 142 normalizes amplitudes 90 and passes the resulting set of accent values 144 to beat strength sorter 146. Beat strength sorter 146 creates an array of beat elements, each comprising a beat onset time and its corresponding accent value. This array is then sorted by accent value and the resulting array 148 of beat elements, ordered by strongest accent value (1.00) to weakest, is passed to an array element selector 140. Array element selector 140 selects beat elements from array 148. These selected beat elements, which contain beat onset times on which to change a displayed image, are then reordered by increasing beat onset times, creating an array 130.

Synchronizer 132 creates a signal 134 which synchronizes the start of music signal 67 and a clock from which pulses to change the image displayed are generated according to array 130 of beat onset times. The output 134 is a synchronized slide-show, which changes the images displayed 122 on beat onsets of music signal 67.

Figure 12:
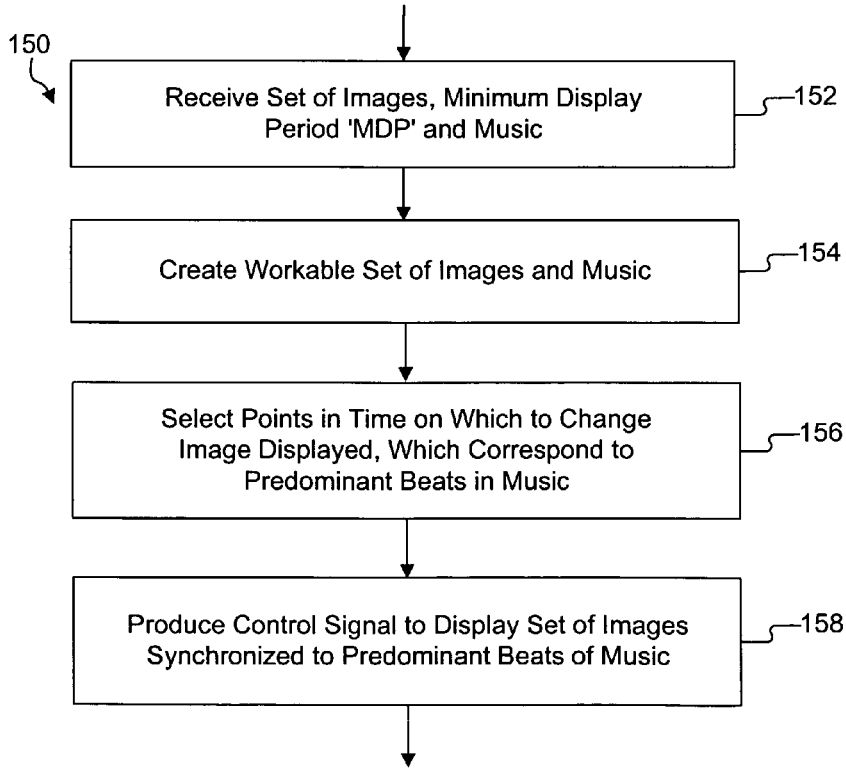
FIG. 12 is a flow diagram of a method consistent with the invention for generating a synchronized signal to advance still images on predominant beats of accompanying music.

FIG. 12 illustrates overall stages in a method 150 for automatically generating an electronic slide show consistent with the invention, performed by the apparatus described above. Method 150 begins by receiving a set of images, a minimum display period MDP, and a set of music data in stage 152. A workable set of images and music data is created in stage 154, such that the average period of time that each image of the workable set will be displayed, during the amount of time required for playback of the music data, is at least equal to an MDP. In stage 156, elapsed time values at which to change the displayed image are selected, the selected times corresponding to onset times of predominant beats in the set of workable music data. Finally, a control signal is produced in stage 158 to advance the display of images within the set of images, synchronized to predominant beats of the music data.

Figure 13:
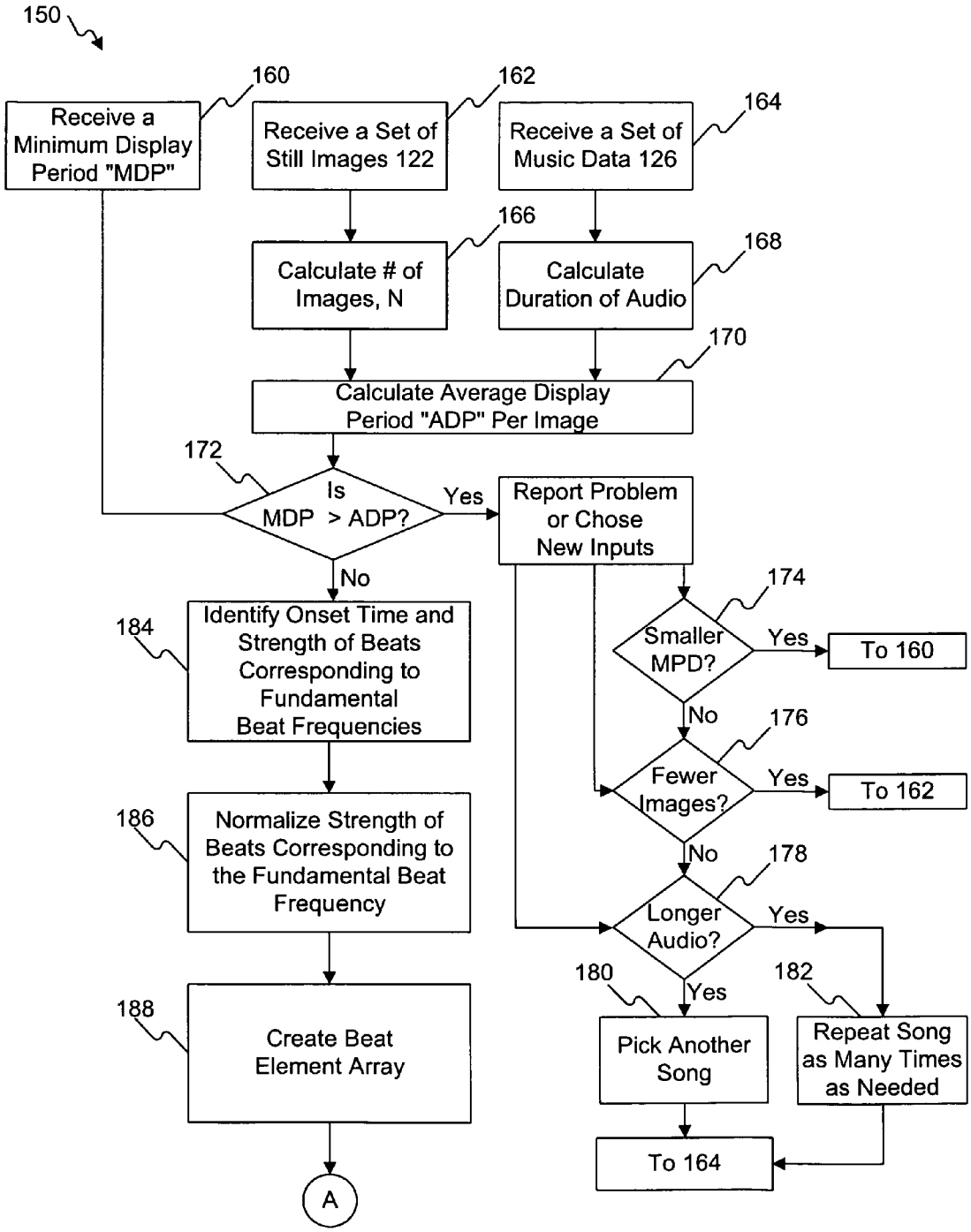
FIG. 13 is a more detailed flow diagram of a preferred embodiment of the method of FIG. 12.
Figure 13:
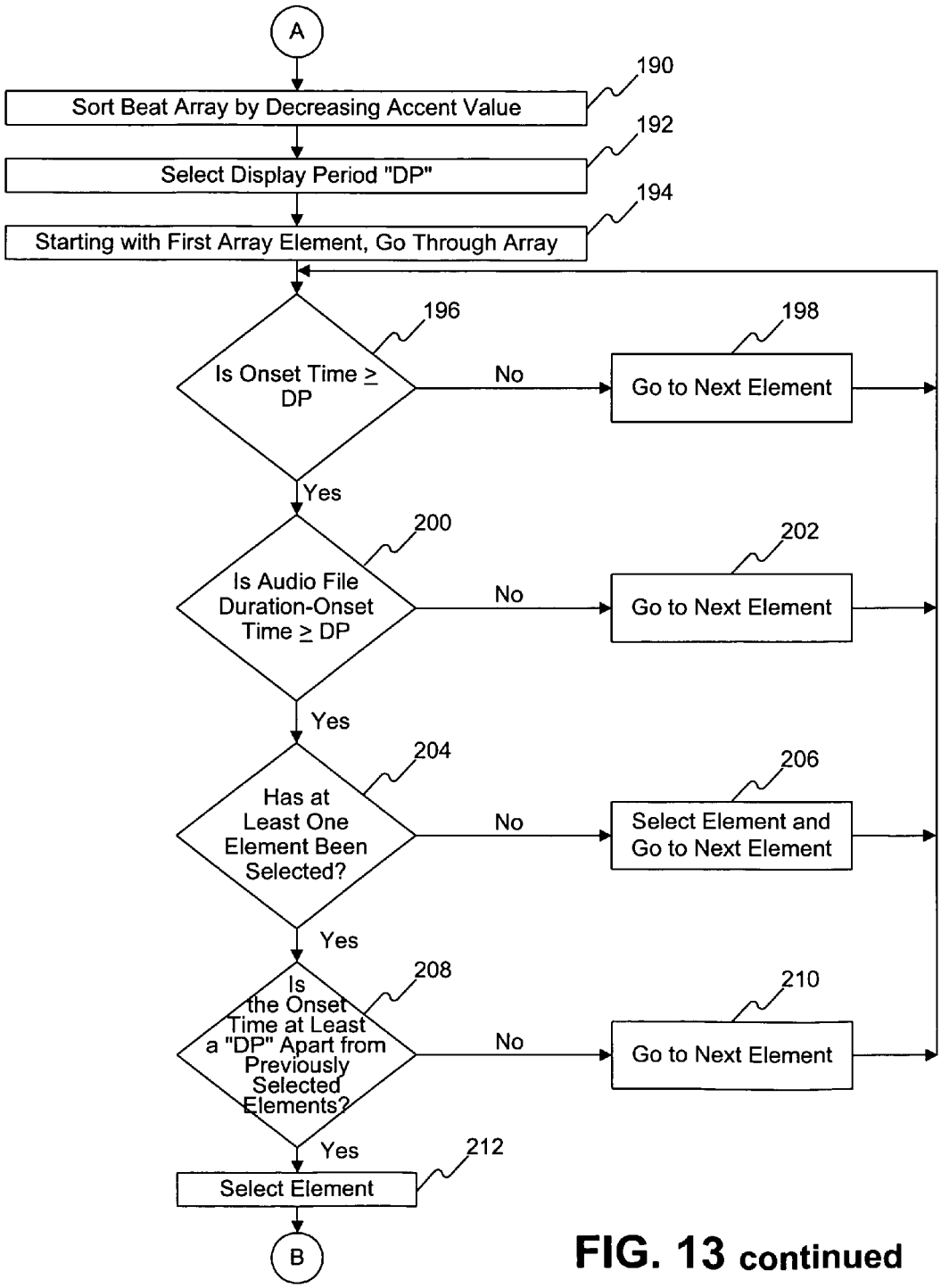
Figure 13:
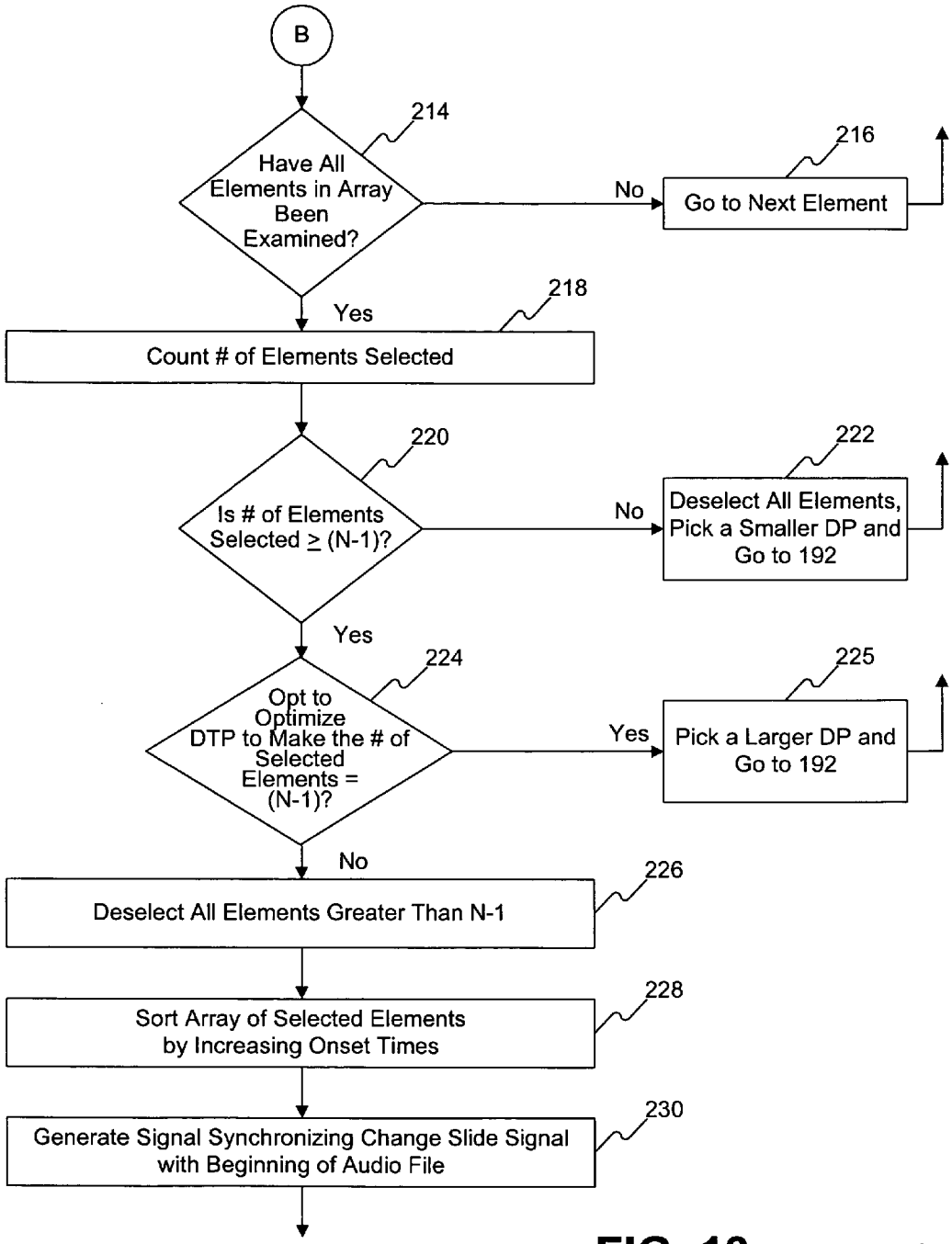

FIG. 13 illustrates detailed stages of one embodiment of method 150. Stages 160 through 164 of FIG. 13 correspond to stage 152 of FIG. 12. In stage 160, method 150 receives a minimum display period "MDP." In stage 162, method 150 receives data comprising a set of still images to display, and in stage 164, method 150 receives a set of music data.

Stages 166 through 182 of FIG. 13 correspond to stage 154 of FIG. 12. The user has specified that each image should be displayed for at least the MDP received in stage 160. The number of images N in the set is determined in stage 166 and the total duration of music signal 126 is calculated in stage 168. An average display period ("ADP") per image may be calculated in stage 170. Stage 172 checks to see if the MDP received is greater than the ADP. If so, the user is prompted to adjust one or more of the inputs to stage 152. For example, the user may decrease minimum display period 124 so that it is equal to or less than the ADP as indicated in stage 174; select fewer images, as indicated in stage 176; or supply a longer music data set, as indicated in stage 178. A longer music data set may comprise a totally new, longer set of music data or may constitute permission to repeat the original music data set as many times as necessary to have an ADP at least equal to the MDP and show all still images. Options for each may be given to the user of the program, or an error message reporting the problem may be display on a user-interface. Stages 160 through 182 are repeated until the answer to stage 172 is "NO." At this point, the inputs of stage 152 are determined to constitute a workable set of music data and images.

Stages 184 through 228 of FIG. 13 correspond to stage 156 of FIG. 12. In stage 184, a method, such as method 100 of FIG. 9, is used to identify the onset time and signal strength (amplitude) of beats corresponding to fundamental beat frequencies of the music data. Stage 186 normalizes the signal strength of each beat, producing an accent value between 1.0 and 0.0. In stage 188, the onset times and corresponding accents values are arranged to form members of each at least two-member element of a beat element array. In stage 190, the array elements are sorted by decreasing accent value.

A display period, "DP," having a value between the ADP and the MDP is generated according to predetermined rules in stage 192. Preferably, the DP is closer to the ADP than the MDP. The DP may be picked as an arbitrary percentage of the ADP, as long as it is greater than the MDP. Preferably, that percentage is 80. The method may also provide for tracking any previously generated DP, so as to allow iteration and optimization.

Next, those beat elements whose onset times are (1) at least equal to the DP, (2) at least a DP less than the time of the end of the music file, and (3) spaced at least a DP apart from every other selected beat element are retained. One selection and retention method is illustrated by stages 194 through 214 of FIG. 13. In stage 194, the onset time of the first element of the beat element array (that is, the element having the highest accent value) is examined. In stage 196, it is compared with the DP. If it is at least equal to the DP, then the method advances to stage 200. If not, the next element in the array is examined in stage 198 and the onset time of that element is compared with the DP in stage 196 again. This cycle repeats until an element is found whose onset time is at least equal to the DP and the method advances to stage 200.

In stage 200, the difference between the duration of the music data and the onset time of the element is compared to the DP. If it is at least equal, then the method advances to stage 204. Otherwise the next element in the beat element array is examined in stage 202 and the onset time of that element compared to the DP in stage 196.

Stage 204 checks to see if at least one element has been selected. If not, then the element is selected and the next element is examined in stage 206 and its onset time is compared to the DP in stage 196. If at least one element has already been selected at stage 204, then the onset time of the element currently being examined is compared to the onset time of all of the previously selected elements in stage 208. If it is at least a DP apart from the onset times of each of the previously selected elements, then the element currently being examined is selected in stage 212. If not, then the next element of the array is examined in stage 210 and its onset time is compared to the DP in stage 196. Stage 214 determines if all elements in the array have been examined. If not, the next element is examined in stage 216 and its onset time is compared to the DP in stage 196.

When all elements have been examined as determined in stage 214, the method proceeds to stage 218, where the selected elements are counted. In stage 220 that count is compared to one less than the number of images in the set "N−1." If N−1 is not less than or equal to the count, then stage 222 deselects all elements, selects a new DP, smaller than the last DP, and the method returns to stage 194.

In an alternative embodiment of stages 194-216, the method includes first selecting all beat elements of array 148 whose onset times are at least a DP from the beginning of the music data and the end of the music data and then comparing them to each other and keeping only those that are spaced apart by at least a DP. Then the number of selected beat elements are compared to the number of images to be displayed. If fewer elements have been selected than images to be displayed, then a new DP, closer to the MDP than the last chosen DP is selected, all onset times are deselected, and the method begins at the top of the array and onset times are selected according to the above procedure.

Another way to select beat elements is to compare the running number of elements selected each time an element is selected at stage 212 and to stop once the number is equal to the desired number preferably N−1. This removes the need for deselecting the selected elements, and reduces time in reaching a set of elements with which to work.

If N−1 is less than or equal to the count, then in stage 224 an optional optimization of the DP may be offered to make the number of selected elements equal to N−1. If an optimization is desired, then stage 225 deselects all elements, selects a new DP, larger than the last, and the method returns to stage 194. If an optimization is not desired, either because the count equals the desired number, N−1, or because the period of time each image is displayed does not have to be approximately the same, stage 226 retains only the N−1 elements with strongest accents and deselects the remainder.

Stage 228 may then sort the set of selected elements by onset time and create an array of chronological beat elements. In stage 230, the chronological beat element array is used to produce a signal to advance the still image displayed and a signal to synchronize the image advance signal with the beginning of the music data, such that all still images in the set will be sequentially displayed for at least the MDP during the duration of the music data.

This new array that provides chronologically ordered times for display initiation of each "slide" may be used, for example, in a software application that creates electronic presentations of video still images synchronized with audio. Such an electronic presentation may be displayed on a computer monitor, burned to optical media in a variety of formats for display on a DVD player, or provided by other methods of output and display.

Another embodiment consistent with the invention is an application which will automatically order and, if necessary, edit a motion video signal to generate a multimedia signal in which significant changes in video content, such as scene breaks or other highly visible changes, occur on the predominant beats in music content. The output provides variation of the video synchronized to the music.

Figure 14:
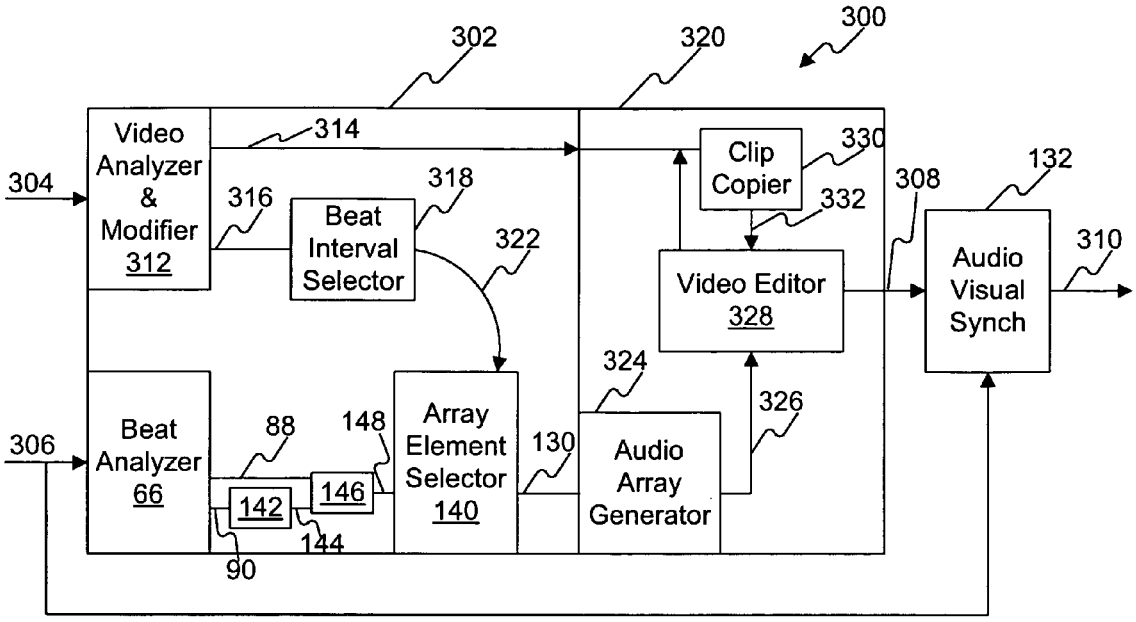
FIG. 14 is block diagram of a music video generator consistent with the invention.

FIG. 14 illustrates a music video generator 300 consistent with the invention. Music video generator 300 comprises a music and video processor 302 which accepts a video signal input 304 and a music signal input 306. Music and video processor 302 supplies a video clip signal 314 and an array 130 of selected beat elements to music and video processor 320, which produces a set of video clips 308, which is synchronized with music signal 306 by audio visual synchronizer 132 to produce a multimedia signal 310 comprising a music video.

Music and video processor 302 comprises a video analyzer and modifier 312 which produces a video clip signal 314 and a video clip duration signal 316. A beat interval selector 318 uses video clip duration signal 316 to select a beat interval 322, which it passes to array element selector 140, previous described. A beat interval is defined as the desired duration of time between selected predominant beats for playing contiguous video content.

Music and video processor 302 also comprises a beat analyzer 66, which provides a set of time-stamps 88 of the fundamental beat onsets of music signal 306 and a set of corresponding beat amplitude values 90. As described in the previous embodiment, accent generator 142 receives amplitude values 90 and creates a set of accent values 144. As previously described, beat strength sorter 146 uses time-stamps 88 and accent values 144 to produce an array of beat elements 148, previously described. Array element selector 140, also previously described, uses beat element array 148, and beat interval 322 to produce an array of selected beat elements, whose beat onset times are each approximately a beat interval 322 apart from each other.

A video clip play order selector 320 comprises an audio duration array generator 324, a video editor 328, and a clip copier 330. Video clip play order selector 320 uses video clip signal 314 and array 130 of selected beat elements from music and audio processor 302 to produce a video output signal 308, comprising an ordered set of motion video clips which change content at intervals approximately equal to beat interval 322. Signals 308 and 306 are supplied to synchronizer 132, which combines signal 308 with music signal 306 to produce a multimedia signal 310 forming a music video.

If the duration of video signal 304 is unequal to the duration of music signal 306, music video generator 300 produces multimedia music video signal 310 by one of two approaches. When the duration of video signal 304 is greater than that of music signal 306, video content can be omitted. On the other hand, when the duration of video signal 304 is less than that of music signal 306, at least a portion of video signal 304 may be repeated. Regardless which approach is used, multimedia music video signal 310 comprises edited clips of video signal 304, wherein each edited video clip changes on a selected subset of the beats corresponding to the fundamental beat frequency of music signal 306.

Figure 15:
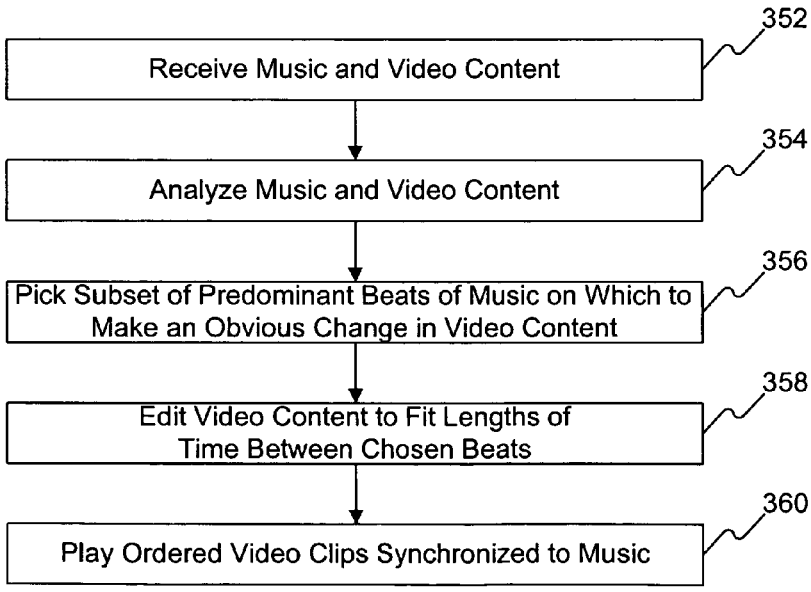
FIG. 15 is a flow diagram of a method consistent with the invention for generating a music video.

FIG. 15 illustrates a method 350 for generating a music video, by which music video generator 300 may operate. In stage 352, the method receives music and video content. In stage 354, it analyzes the music and video content to determine a set of predominant beats and video clips, respectively. In stage 356, the method selects a subset of predominant beats of music signal 306 on which to make significant changes in video content. In stage 358 it edits video content to fit the lengths of time between the selected beats. In stage 360 it generates a multimedia signal comprising the edited video clips synchronized to the music.

Considering method 350 in greater detail, in stage 354, the method preferably detects significant changes, comprising highly visible changes such as scene breaks present in video content input 304. These changes may be detected by a standard video scene detection process, as is well known to those skilled in the art. Stage 354 preferably creates separate video clips, each bracketed by a significant change. Alternately if video signal 304 is one long video clip, it may just be subdivided into a number of smaller video clips regardless of the placement of any highly visible changes within the clip. The method of subdivision may take the overall duration of the single video clip into consideration, in selecting the approximate duration of the resulting smaller video clips created by subdividing the single video clip. Preferably, if the single video clip is between 2 to 4 seconds in duration, then it is divided into two video clips, one of which is two seconds in duration. Preferably, if the single video clip is between 4 and 32 seconds in duration, then it is divided into at least two video clips, at least one of which is four seconds in duration. Preferably if the single video clip is greater than 32 seconds, it is divided into at least four video clips, at least four of which are 8 seconds in duration. Alternately video signal 304 already comprises video clips bracketed by a significant change. In each of these alternative options, the video content maybe modified by automatically removing unwanted scenes or applying effects, such as transitions or filters. The method of modification may comprise algorithms well known to those skilled in the art. Lastly, in each of these alternative options, the duration characteristics of the resulting video clips need to be determined, including the minimum, maximum, and average video clip duration. Stage 354 preferably uses method 100 to identify the set of predominant beats corresponding to the fundamental beat frequencies of music signal 306.

In stage 356, method 350 may determine how often to change video clips, or in other words, to chose a beat interval. In an embodiment consistent with the invention, the preferred beat interval for playing each video clip is two seconds. If the average video clip duration as determined in stage 354 is less than two seconds, the beat interval is set to the average video clip duration. Stage 356 then divides the total duration of music signal 306 by the beat interval, thereby determining the number of possible video clips that can be shown within the total duration of music signal 306.

Stage 356 then selects the beats according to a modified and abbreviated method 150. The modification includes setting N, the number of still images to be displayed, equal to the whole number of possible video clips that can be shown and setting the display period, DP, equal to the beat interval in stage 192. The abbreviation is that the method starts with stage 192. The preferred method will not choose a new display period, DP, if stages 192 through 218 select fewer selected elements than N−1 (i.e., the answer "NO" to step 220 of FIG. 13 will not result in stage 222 being performed), nor perform stage 225 (optimization of the display period), but will output the number of beat elements selected the first time through the entire beta element array using DP set equal to the selected beat interval.

In general, stage 358 creates a significant change in video content on every selected beat and a chronological series of video scenes when none of the original video scenes are long enough to fill a particular audio duration. Specifically, the preferred steps of stage 358 follow. Given the array of selected beats from stage 356, the method constructs an array of audio durations 326 in stage 358. The audio durations it calculates and enters as elements of the array include the duration between the beginning of the music file and the onset time of first selected beat, the durations between each pair of onset times from chronologically occurring selected beats, and the duration between the onset time of the last selected beat and the end of the Stage 358 also receives the earlier created video clips and creates a copy of them for use in a list from which they will be selected individually for examination, possible editing and ordering for concurrent play with an audio duration.

As an overall approach, stage 358 continues by examining each video clip and selecting those whose duration is equal to or exceeds an unfilled audio duration in audio array 326. If a video clip's duration exceeds an audio duration, the video clip is edited by shortening it to match the audio duration. Preferably, the video clip is edited by trimming off the end portion that exceeds the audio duration, but other editing techniques may be used. The selected and/or edited video clips are then ready to be ordered for concurrent playing with musical signal 306.

Boundary conditions may be enforced to improve video content. For example, an extremely long video clip should be initially subdivided into smaller video clips, from which stage 358 may select and further edit. Also, an edited video clip should not be followed by material trimmed from its end and the same video clip should not be used for two successive audio durations. When the resulting video clips are sequentially ordered, then played with music signal 306, each audio duration will be accompanied by the display of different video content than displayed with the previous audio duration, and a significant change in video content occurs on a beat.

Stage 358 preferably uses the following specific steps to select video clips to fill the length of time of each audio duration in array 326. First, it receives the copied list of original video clips from clip copier 330. Starting with the first video clip ("VC") and proceeding through each one in the list, it examines each clip according to rules set forth below.

FIGS. 16*a-d*, illustrate an example of how a stage 358 works using a hypothetical video content signal 304 and a hypothetical music signal 306. A nine (9) minute video 304, is received in stage 352 and is divided into five video clips (visual scenes) of the following durations in stage 354 listed in Table 2.

TABLE 2

| Scene/Video Clip # | Duration (seconds) |
|---|---|
| 400 | 120 |
| 403 | 90 |
| 406 | 5 |
| 409 | 315 |
| 412 | 10 |

In this hypothetical example, a four (4) minute digital music signal 306 has been selected by the user, in which beats corresponding to the fundamental beat frequency have been identified in stage 354. Using a beat interval of 12 seconds, a subset of predominant beats has been selected in stage 356 and stage 358 has already created the following audio duration array listed in Table 3.

TABLE 3

| Audio Duration # | Duration (seconds) |
|---|---|
| AD1 | 12.30 |
| AD2 | 12.42 |
| AD3 | 12.15 |
| AD4 | 11.99 |
| AD5 | 11.92 |
| . . . | . . . |
| AD20 (ADn) | 12.00 |

Stage 358 compares the duration of the first video clip ("VC") in the list to the first audio duration, AD1, of the audio duration array. If the first VC is at least equal in duration to AD1, stage 358 selects it and trims a portion from its end equal to the duration greater than AD1. It then moves the trimmed portion of the first VC to the end of the list of video clips available for filling remaining audio durations. The remaining portion of the first VC is removed from the list and ordered as number 1 for playing concurrently with the music.

Figure 16A:
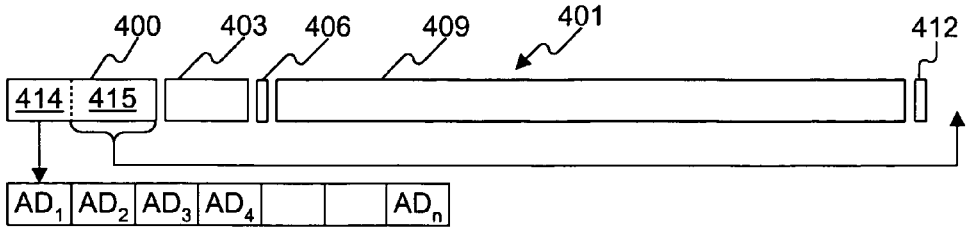
FIGS. 16*a-d* are snapshots of results of an embodiment consistent with a portion of the method of FIG. 15.

FIG. 16*a* shows the initial configuration of the list 401 of video clips of an example signal 304 and audio durations of an example music signal 306, where original video clip 400 is longer in duration than audio duration 1 ("AD1") (120>12.3 seconds). A portion of VC 400 is trimmed from the end thereof, so that the remaining duration is equal to AD1. Trimmed portion 415 is placed last in list 401 of video clips being considered as sources to fill the remaining audio durations. Edited VC 414 is selected and removed from list 401.

Returning to the preferred steps of stage 358, after AD1 has been filled with a video clip, the duration of the next video clip in the list is compared to audio duration 2 ("AD2"). If the duration of the next video clip is at least equal to AD2, the next video clip is selected and any portion exceeding AD2 is trimmed from its end. The trimmed portion of the next video clip is placed at the end of the list of available video clips for filling remaining audio durations and the remaining version of the next video clip is removed from the list and ordered for concurrent playing with AD2. Again, if it is not at least equal to AD2, it is moved to the end of the list of available video clips and the process continues with another video clip, next in the list that has not yet been compared to AD2.

Figure 16B:
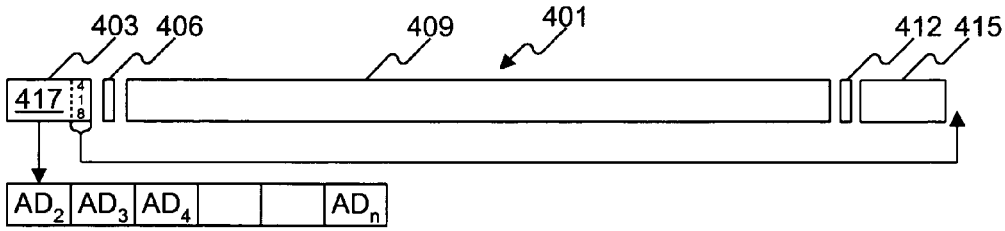

FIG. 16*b* illustrates the above paragraph, where original video clip ("VC") 403 is longer in duration than audio duration 2 ("AD2") (90>12.4 seconds). A portion of VC 403 is trimmed from the end thereof, such that the remaining duration is equal to AD2. Trimmed portion 418 is placed last in list 401 of video clips being considered as sources to fill the remaining audio durations. Edited VC 417 is selected and removed from list 401.

Stage 358 continues such that if an examined video clip is not at least equal to an AD, then it is moved to the end of the list of video clips available for filling remaining audio durations and the next original video clip's duration is compared to the AD. The same process is repeated for each subsequent video clip that is not at least equal to the AD.

Figure 16C:
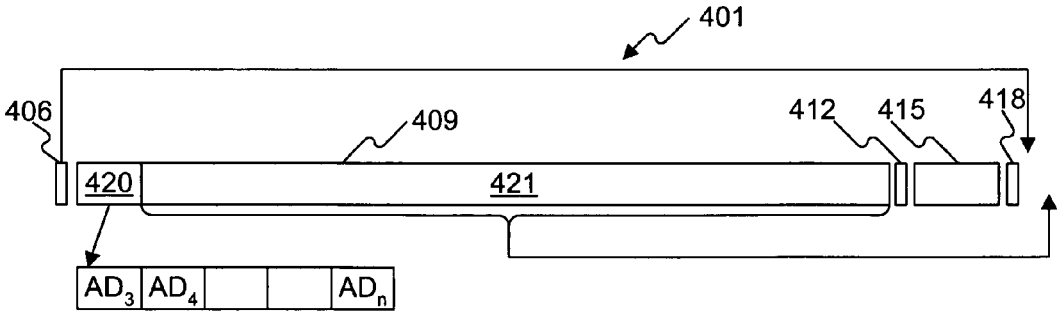

FIG. 16*c* illustrates the above paragraph, where original video clip 406 is less than audio duration 3 ("AD3") (5<12.1 seconds). It is placed last in list 401 of video clips being considered as sources to fill the remaining audio durations. Original video clip 409 is longer in duration than AD3 (315>12.1 seconds). A portion of VC 409 is trimmed from the end thereof, such that the remaining duration is equal to AD3. Trimmed portion 421 is placed last in list 401 of video clips being considered as sources to fill the remaining audio durations. Edited VC 420 is selected and removed from list 401.

Figure 16D:
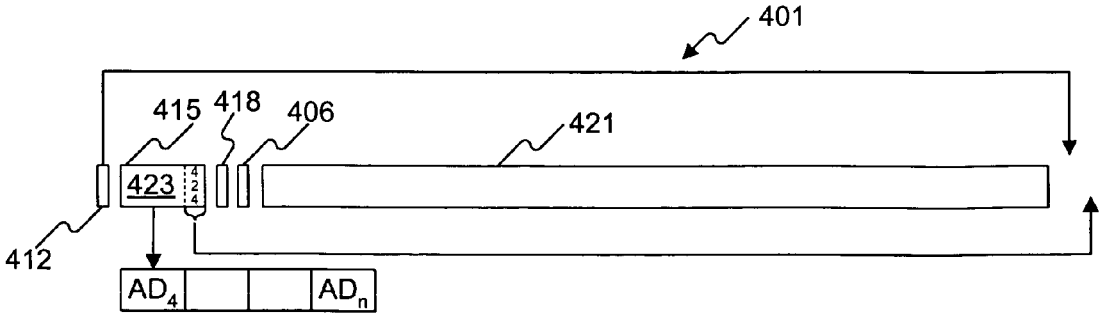

FIG. 16*d* shows the next intermediate configuration, where original VC 412 is less than audio duration 4 ("AD4") (10<11.9 seconds). It is placed last in list 401 of video clips being considered as sources to fill the remaining audio durations. Trimmed portion 415 is longer in duration than AD4. A portion of VC 415 is trimmed from the end thereof, such that the remaining duration is equal to AD4. Newly trimmed portion 424 is placed after video clip 412 in list 401 of video clips being considered as sources to fill the remaining audio durations. Edited VC 423 is removed from list 401.

As stage 358 continues to work its way through the audio duration array, when none of the video clips (trimmed or otherwise) in the list of video clips available to fill remaining audio durations have durations at least equal to the current audio duration to be filled, then all video clips in the list are removed and stage 358 makes another copy of the original video clips. Copy 322 of the original video clips becomes the list of available video clips and stage 358 starts with the first video clip and continues until all audio durations have been filled or, again, until no single original video clip is long enough to fill an audio duration.

When no remaining video clip in the list is long enough to fill an audio duration, stage 358 makes another copy of the original video clips 322 and selects the smallest subset of chronological video clips that is at least equal to the audio duration to be filled. The need for the above steps most often occurs at the end of a music signal 306. Preferably stage 358 selects the smallest subset by matching the end of the music signal 306 to the end of the chronological video clips and trimming off a portion from the beginning thereof, such that the remaining duration is equal to the audio duration to be filled. In this particular instance, the series of chronological video clips ends at the same time as music signal 306, and the duration of the series corresponds to the audio duration. This will a significant change in video to occur when no beats corresponding to the fundamental beat frequency occur, but creates a natural ending of the video.

When all audio durations have been filled, stage 360 then sorts the selected video clips by play order and synchronized them with musical signal 306 to create multimedia signal 134 in which significant changes in video content occur on beats corresponding to the fundamental beat frequency of the music file.

This information is useful in a number of applications, a few of which have been detailed herein. However, one may appreciate the expansive breadth of this invention.

Other embodiments consistent with the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A computer-implemented method of detecting a fundamental beat frequency in a predetermined time interval of a music signal, comprising:

a) processing a music signal with the discrete wavelet transform to obtain a set of coefficients;

b) processing a subset of the coefficients to obtain a plurality of candidate beat frequencies contained in the corresponding portion of the music signal;

c) determining the harmonic relationships between the candidate beat frequencies;

d) determining the fundamental beat frequency based upon the determined harmonic relationships; and e) storing information about the determined fundamental beat frequency in a memory for use in production of a multimedia composition.

2. The computer-implemented method of claim 1, wherein determining the fundamental beat frequency comprises selecting one of the candidate beat frequencies having a non-ambiguous harmonic structure.

3. The computer-implemented method of claim 1, wherein determining harmonic relationships comprises determining integer relationships between the candidate beat frequencies.

4. The computer-implemented method of claim 1, wherein:

the candidate beat frequencies each comprise a range of frequencies;

processing a subset of the coefficients comprises calculating autocorrelation values; and determining the fundamental beat frequency comprises:

identifying the candidate beat frequency having a non-ambiguous harmonic structure and the strongest relative amplitude value calculated to model human auditory perception;

determining the harmonic relationship between the candidate beat frequency having a non-ambiguous harmonic structure and the strongest relative amplitude value calculated to model human auditory perception, and the lowest candidate frequency having a non-ambiguous harmonic structure; and selecting the fundamental beat frequency as the frequency range of the lowest candidate beat frequency having a non-ambiguous harmonic structure multiplied by the harmonic relationship.

5. The computer-implemented method of claim 1, wherein processing a subset of the coefficients to obtain a plurality of candidate beat frequencies comprises calculating autocorrelation values of a subset of the coefficients; and determining the fundamental beat frequency comprises determining the fundamental beat frequency based upon the determined harmonic relationships and the relative amplitude values calculated to model human auditory perception.

6. The computer-implemented method of claim 1, wherein processing a subset of the coefficients to obtain a plurality of beat frequencies comprises creating a buffer of a predetermined number of coefficients.

7. The computer-implemented method of claim 6, wherein processing a subset of the coefficients comprises creating a dynamic and weighted histogram of beat frequencies.

8. The computer-implemented method of claim 7, wherein creating a dynamic and weighted histogram comprises consolidating values in adjacent bins of the histogram.

9. The computer-implemented method of claim 8, wherein consolidating values in adjacent bins of the histogram comprises using a mathematical window function.

10. An apparatus for analyzing the beat of a music signal comprising:

a fundamental beat frequency identifier generating a fundamental beat frequency signal from the music signal;

a time domain envelope analyzer comprising a peak generator generating a peak signal from the music signal, the peak signal comprising amplitude and time values of amplitude peaks of the music signal;

a comparator and beat identifier, coupled to the fundamental beat frequency identifier and the time domain envelope analyzer, and generating, from the peak signal and fundamental beat frequency signal, a series of time values identifying the amplitude peaks corresponding to onset times of beats within periods based on the fundamental beat frequency signal; and a memory for storing information about the determined fundamental beat frequency for use in production of a multimedia composition.

11. A computer-implemented method of detecting the localized fundamental beat frequency of a digital music signal comprising:

detecting time period peaks above a threshold in at least two, consecutive, predetermined-sized buffers of an autocorrelation function of a decomposition of a digital music signal using a discrete wavelet transform;

determining which one or more of the detected time period peaks is heard most often in the at least two, consecutive, predetermined-sized buffers, thereby creating a set of "often-heard" beat frequencies in a localized portion of the digital music signal and wherein one or more beat frequencies in the set has a magnitude representing how often it is heard;

determining the harmonic structure between each beat frequency in the set and the remaining beat frequencies in the set;

selecting one of the "often heard" beat frequencies as the localized fundamental beat frequency, wherein the criteria for selection comprise the greatest magnitude and a non-ambiguous harmonic structure; and storing information about the determined fundamental beat frequency in a memory for use in production of a multimedia composition.

12. The computer-implemented method of claim 11, wherein detecting time period peaks above a threshold comprises:

half-wave rectifying the autocorrelation values of the at least two consecutive predetermined-size buffers of the autocorrelation function;

identifying time period peaks based on the rectified autocorrelation values; and comparing the rectified autocorrelation values of the identified time period peaks to a threshold, thereby detecting time period peaks above a threshold.

13. The computer-implemented method of claim 12, wherein identifying time period peaks based on the rectified autocorrelation values comprises:

determining the maximum rectified autocorrelation value and an average noise value of the rectified autocorrelation values;

indicating the start of a peak as a time period whose rectified autocorrelation value is greater than the previous autocorrelation value and greater than the average noise value of the rectified autocorrelation values; and identifying the time period corresponding to the turnover point after the start of a peak as a time period peak; and wherein the threshold equals a predetermined percentage of the maximum rectified autocorrelation value.

14. The computer-implemented method of claim 11, wherein determining which one or more of the detected time period peaks is heard most often comprises:

providing a histogram bin for each frequency corresponding to a time period in the autocorrelation function;

creating a dynamic and weighted histogram of integrated autocorrelation values of detected time period peaks in two or more consecutive buffers of the at least two consecutive, predetermined-sized buffers, wherein creating the dynamic and weighted histogram comprises:

integrating the autocorrelation values of detected time period peaks in the two or more consecutive buffers by multiplying them by a predetermined integration value;

increasing the corresponding histogram bin's value by the integrated autocorrelation value of a detected time period peak; and decreasing the corresponding histogram bin's value by the predetermined integration value to a minimum of zero if the time period of the auto correlation function is not a detected time period peak, thereby creating a dynamic and weighted histogram; and picking the one or more frequencies corresponding to the histogram bins with peak values as the set of "often heard" beat frequencies in the localized portion of the music signal, wherein each frequency in the set has a magnitude represented by the histogram bin value.

15. The apparatus of claim 10, further comprising a preprocessor to convert an input music signal having a number of channels and a sampling rate to a music signal having one channel and a 22.05 kHz sampling rate.

16. The apparatus of claim 10, further comprising a time stamp adjuster to set the time values of the series of time values generated by the comparator and beat identifier to the time difference between the beat onset and the start of the music signal.

17. A computer-implemented method of identifying beats in a music signal that correspond to a fundamental beat frequency comprising:

determining a fundamental beat frequency in a music signal using a discrete wavelet transform;

obtaining an envelope signal of the music signal, wherein the envelope signal contains amplitude peaks of the music signal that represent beats in the music signal;

identifying one or more peaks in the envelope signal as beats in a music signal that correspond to a fundamental beat frequency; and storing information about the determined fundamental beat frequency in a memory for use in production of a multimedia composition.

* * * * *